US009631323B2

(12) United States Patent
Maladen et al.

(10) Patent No.: US 9,631,323 B2
(45) **Date of Patent: *Apr. 25, 2017**

(54) SANITARY TISSUE PRODUCTS WITH SUPERIOR MACHINE DIRECTION ELONGATION AND FORESHORTENING PROPERTIES AND METHODS FOR MAKING SAME

(71) Applicant: The Procter & Gamble Company, Cincinnati, OH (US)

(72) Inventors: Ryan Dominic Maladen, Anderson Township, OH (US); John Allen Manifold, Sunman, IN (US); Ward William Ostendorf, West Chester, OH (US); Jeffrey Glen Sheehan, Symmes Township, OH (US); Douglas Jay Barkey, Salem Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/131,150

(22) Filed: Apr. 18, 2016

(65) Prior Publication Data

US 2016/0230347 A1 Aug. 11, 2016

Related U.S. Application Data

(63) Continuation of application No. 14/574,421, filed on Dec. 18, 2014, now Pat. No. 9,315,946.

(60) Provisional application No. 61/951,816, filed on Mar. 12, 2014, provisional application No. 61/918,398, filed on Dec. 19, 2013, provisional application No. 61/918,404, filed on Dec. 19, 2013, provisional application No. 61/918,409, filed on Dec. 19, 2013.

(51) Int. Cl.

| | |
|---|---|
| ***D21H 27/04*** | (2006.01) |
| ***D21H 11/04*** | (2006.01) |
| ***D21H 27/40*** | (2006.01) |
| ***D21H 27/00*** | (2006.01) |
| ***D21H 27/30*** | (2006.01) |
| *D21H 21/20* | (2006.01) |

(52) U.S. Cl.

CPC ..... *D21H 27/40* (2013.01); *D21H 27/005* (2013.01); *D21H 27/30* (2013.01); *D21H 11/04* (2013.01); *D21H 21/20* (2013.01)

(58) Field of Classification Search

CPC .... D21H 27/005; D21H 27/002; D21H 27/30; D21H 27/02; D21H 27/007; D21H 11/00; D21H 27/00; D21H 27/38; D21H 25/005; D21H 27/40; B31F 1/07; B31F 1/12; B31F 1/16; B32B 3/30; B32B 3/28; D21F 11/006; Y10T 428/253

See application file for complete search history.

(56) References Cited

U.S. PATENT DOCUMENTS

| | | | | |
|---|---|---|---|---|
| 4,637,859 | A * | 1/1987 | Trokhan | D21H 25/005 162/109 |
| D464,203 | S * | 10/2002 | Manifold | D5/53 |
| 7,585,389 | B2 * | 9/2009 | Yeh | B31F 1/126 162/111 |
| 7,939,168 | B2 * | 5/2011 | Manifold | D21H 27/002 162/109 |
| 7,960,020 | B2 * | 6/2011 | Manifold | D21H 27/02 162/109 |
| 8,034,463 | B2 * | 10/2011 | Leimbach | D21H 27/005 162/158 |
| 8,216,427 | B2 * | 7/2012 | Klerelid | D21F 11/006 162/116 |
| 8,366,878 | B2 * | 2/2013 | Klerelid | D21F 11/006 162/116 |
| 8,574,400 | B1 * | 11/2013 | Shannon | D21H 11/00 162/129 |
| 8,652,634 | B2 * | 2/2014 | Manifold | D21H 27/00 162/109 |
| 8,771,468 | B2 * | 7/2014 | Shannon | D21H 11/00 162/129 |
| 9,315,946 | B2 * | 4/2016 | Maladen | D21H 27/30 |
| 2008/0008865 | A1 * | 1/2008 | Luu | B32B 33/00 428/219 |
| 2009/0220741 | A1 * | 9/2009 | Manifold | D21H 27/005 428/141 |
| 2009/0220769 | A1 * | 9/2009 | Manifold | D21H 15/06 428/326 |
| 2009/0297781 | A1 * | 12/2009 | Huss | B31F 1/07 428/166 |
| 2010/0040825 | A1 * | 2/2010 | Manifold | D21H 27/30 428/97 |
| 2011/0027563 | A1 * | 2/2011 | Manifold | D21H 27/005 428/220 |
| 2011/0189451 | A1 * | 8/2011 | Manifold | D21H 27/002 428/219 |
| 2012/0034430 | A1 * | 2/2012 | Nelson | D21H 27/002 428/195.1 |
| 2012/0107568 | A1 * | 5/2012 | Manifold | D21F 11/006 428/169 |
| 2013/0040101 | A1 * | 2/2013 | Fung | D21H 27/005 428/141 |
| 2013/0071624 | A1 * | 3/2013 | Manifold | D21H 27/002 428/171 |
| 2013/0143001 | A1 * | 6/2013 | Manifold | D06C 23/04 428/167 |
| 2013/0209749 | A1 * | 8/2013 | Myangiro | D21F 7/086 428/174 |

(Continued)

*Primary Examiner* — Jose Fortuna

(74) *Attorney, Agent, or Firm* — C. Brant Cook

(57) ABSTRACT

Fibrous structures and/or sanitary tissue products comprising fibrous structure, and more particularly to fibrous structures comprising pulp fibers, wherein the fibrous structures exhibit unique elongation (stretch) and total foreshortening properties, and methods for making such fibrous structures.

14 Claims, 10 Drawing Sheets

(56) References Cited

U.S. PATENT DOCUMENTS

| | | | | |
|---|---|---|---|---|
| 2013/0292073 | A1* | 11/2013 | Manifold | D21H 27/02 162/109 |
| 2013/0319625 | A1* | 12/2013 | Mohammadi | D21H 27/02 162/111 |
| 2014/0053994 | A1* | 2/2014 | Manifold | D21H 27/002 162/118 |
| 2014/0147637 | A1* | 5/2014 | Manifold | D21H 27/00 428/172 |
| 2015/0240426 | A1* | 8/2015 | Hermans | D21H 27/005 162/109 |
| 2016/0053439 | A1* | 2/2016 | Hermans | D21H 27/005 162/109 |
| 2016/0230347 | A1* | 8/2016 | Maladen | D21H 27/005 |

* cited by examiner

SANITARY TISSUE PRODUCTS WITH SUPERIOR MACHINE DIRECTION ELONGATION AND FORESHORTENING PROPERTIES AND METHODS FOR MAKING SAME

FIELD OF THE INVENTION

The present invention relates to fibrous structures and/or sanitary tissue products comprising fibrous structures, and more particularly to fibrous structures comprising pulp fibers, wherein the fibrous structures exhibit unique elongation (stretch) and total foreshortening properties, and methods for making such fibrous structures.

BACKGROUND OF THE INVENTION

Creating machine direction (MD) elongation in sanitary tissue products such as bath tissue, paper towels, and facial tissue, that comprise fibrous structures that comprise pulp fibers, especially wet-laid fibrous structures, has been a challenge for formulators. Formulators have been limited to creating MD elongation in such sanitary tissue products primarily by one way; namely, foreshortening the fibrous structures during the fibrous structure making process, for example papermaking process. Foreshortening includes both process induced foreshortening and structure induced foreshortening. Both process induced foreshortening and structure induced foreshortening operations build MD elongation into the fibrous structure during the fibrous structure making process.

Process induced foreshortening operations include wet microcontraction operations and/or rush transfer operations, which include fabric creping and/or belt creping operations, creping operations that crepe the fibrous structure off a drying cylinder, for example off a Yankee, and microcreping operations, such as passing the fibrous structure through a microcreper, for example a microcreper commercially available from Micrex Corporation. The effect of process induced foreshortening is the generation of ridges, oftentimes referred to as "crepe ridges" especially those resulting from creping the fibrous structure off a drying cylinder. The limitations and placement of the process induced foreshortening operations results in the ridges being substantially oriented along the cross machine direction (CD) in the resulting fibrous structure. Further, process induced foreshortening negatively impacts the tensile strength, especially the MD tensile strength of the fibrous structure. Due to these negatives associated with process induced foreshortening operations, there is a desire to at a minimum not increase and even reduce the % foreshortening imparted to a fibrous structure by process induced foreshortening operations, but to do so requires foreshortening to be imparted to the fibrous structure by other ways, such as structure induced foreshortening, in order to maintain and/or increase the MD elongation of the fibrous structure.

Formulators have foreshortened fibrous structures during the fibrous structure making process by other process induced foreshortening operations such as wet microcontraction and/or rush transfer, where the fibrous structure is transferred from an upstream operation that is running at a faster speed than a downstream operation, to build MD elongation in the fibrous structures. For example, a rush transfer operation may include a forming wire in a fibrous structure making process running at a faster speed than a transfer fabric and/or through-air-drying fabric, such as is found in an uncreped through-air-dried (UCTAD) process, onto which the fibrous structure is transferred from the forming wire. In another example, a creping roll in a fabric and/or belt crepe operation may be run at a faster speed than the fabric and/or belt that receives the fibrous structure from the creping roll. In still another example, a fibrous structure may be creped (% crepe) from a drying cylinder (i.e., a Yankee) by a doctor blade wherein the drying cylinder is moving at a faster speed than the doctor blade, which is typically stationary in the machine direction. All of these operations are process induced foreshortening operations. For purposes of the present invention, total foreshortening (TFS)=total process induced foreshortening=wet microcontraction+rush transfer+% crepe+microcreping. Process induced foreshortening of a fibrous structure being made generates MD elongation in the fibrous structure. However, the amount of total foreshortening and thus MD elongation resulting from process induced foreshortening that can be imparted to a fibrous structure during the fibrous structure making process has a limit. Therefore, formulators have looked at different ways to build MD elongation into fibrous structures, for example by looking at different through-air-drying fabric and/or patterned belt designs to impart additional MD elongation, with or without process induced foreshortening operations, to the fibrous structures during structure induced foreshortening operations.

Structure induced foreshortening operations include forming and/or drying a fibrous structure on a through-air-drying fabric and/or a patterned through-air-drying belt (a belt that has a three-dimensional material, such as polymer resin in a discrete, semi-continuous, and/or continuous pattern of protuberances or knuckles, which define a discrete, semi-continuous, and/or continuous pattern of deflection conduits or pillows in areas that are void of the protuberances (knuckles). The deflection of the fibrous structure into the deflection conduits (pillows, lower fiber density region) in the patterned belt generates knuckle (non-deflected—higher fiber density region) and pillow pattern to the fibrous structure during the fibrous structure making process which coupled with the pattern results in foreshortening of the fibrous structure. Unlike process induced foreshortening operations, structure induced foreshortening operations do not negatively impact or not as significantly, the tensile strength, especially the MD tensile strength of the fibrous structure made.

To date, formulators have fallen short of making sanitary tissue products comprising a fibrous structure comprising a plurality of pulp fibers that exhibit consumer desired MD elongation properties per total foreshortening (total process induced foreshortening). For all else equal, fibrous structures comprising pulp fibers that exhibit a high MD elongation/TFS will exhibit a higher tensile strength. Formulators have made sanitary tissue products employing fibrous structures that have been made on various through-air-drying fabrics and/or patterned belts without achieving a consumer desired MD elongation to total foreshortening (total process induced foreshortening) ratio. In one example, a prior art sanitary tissue product employing a fibrous structure made using a patterned through-air-drying belt having a surface pattern shown in prior art FIG. 1, where the line elements were substantially oriented in the machine direction, exhibited a MD elongation to total foreshortening (total process induced foreshortening) ratio of 2.22 or less. Other sanitary tissue products employing fibrous structures that have been made on patterned through-air-drying belts having a continuous knuckle pattern and a process induced foreshortening of 0 or greater exhibited MD elongation to total foreshortening (total process induced foreshortening) ratios of 2.43 or less.

Further, other sanitary tissue products employing fibrous structures that have been made on various through-air-drying fabrics, which obviously are limited in their design due to the nature of the warp and weft of the fabrics, exhibited MD elongation to total foreshortening (total process induced foreshortening) ratios of less than 2.22. In addition, sanitary tissue products employing fabric creped and belt creped fibrous structures and uncreped through-air-dried fibrous structures all have exhibited MD elongation to total foreshortening (total process induced foreshortening) ratios of less than 2.22. Therefore, the problem addressed by the present invention is how to generate increased MD elongation in a fibrous structure during a fibrous structure making process, for example a papermaking process, using structure induced foreshortening, for example using a new through-air-drying fabric design and/or new patterned through-air-drying belt design such that a sanitary tissue product employing the fibrous structure exhibits a consumer desired MD elongation to total foreshortening (total process induced foreshortening) ratio; namely, a MD elongation to total foreshortening (total process induced foreshortening) that is greater than such ratio in known sanitary tissue products.

Accordingly, there is a need for a sanitary tissue product that exhibits a MD elongation to total foreshortening (total process induced foreshortening) ratio that is greater than such ratios in known sanitary tissue products, and methods for making such sanitary tissue products.

SUMMARY OF THE INVENTION

The present invention fulfills the need described above by providing a sanitary tissue product that exhibits a MD elongation to total foreshortening (total process induced foreshortening) ratio that is greater than such ratios in known sanitary tissue product, and methods for making such sanitary tissue products.

A solution to the problem identified above is a sanitary tissue product comprising a fibrous structure comprising a plurality of pulp fibers that exhibits a consumer desired MD elongation to total foreshortening (total process induced foreshortening process induced foreshortening) ratio; namely, a MD elongation to total foreshortening (total process induced foreshortening) that is greater than such ratio in known sanitary tissue products, as described above. A non-limiting way to achieve this desired MD elongation to total foreshortening (total process induced foreshortening) ratio in the sanitary tissue products of the present invention is to make the fibrous structure on a through-air-drying fabric and/or a patterned through-air-drying belt that imparts a plurality of substantially cross machine direction (CD) oriented line elements in the fibrous structure. In other words, making the fibrous structure on a through-air-drying fabric and/or patterned through-air-drying belt that comprise a plurality of knuckles that are substantially CD oriented. It has unexpectedly been found that making fibrous structures, especially comprising a plurality of pulp fibers, on such through-air-drying fabrics and/or patterned through-air-drying belts provide sanitary tissue products employing such fibrous structures with a MD elongation to total foreshortening (total process induced foreshortening) ratio of greater than 2.25 where the fibrous structure and through-air-drying fabric and/or patterned through-air-drying belt comprise discrete and/or semi-continuous knuckles (in other words is void of a continuous knuckle). It has also been unexpectedly found that making fibrous structures, especially comprising a plurality of pulp fibers, on such through-air-drying fabrics and/or patterned through-air-drying belts where the process induced foreshortening is 0% or greater provide sanitary tissue products employing such fibrous structures with a MD elongation to total foreshortening (total process induced foreshortening) ratio of greater than 2.5.

In one example of the present invention, a fibrous structure and/or sanitary tissue product comprising a fibrous structure, for example a through-air-dried fibrous structure and/or sanitary tissue product, comprising a plurality of pulp fibers, wherein the fibrous structure is void of a continuous knuckle (comprises discrete and/or semi-continuous knuckles) and wherein the sanitary tissue product exhibits a MD elongation to total foreshortening (total process induced foreshortening) ratio of greater than 2.25 as measured according to the Elongation Test Method described herein, is provided.

In another example of the present invention, a fibrous structure and/or sanitary tissue product comprising a fibrous structure, for example a through-air-dried fibrous structure and/or sanitary tissue product, comprising a plurality of pulp fibers, wherein the fibrous structure comprises a pattern of semi-continuous high density knuckle regions and a pattern of semi-continuous low density pillow regions, wherein the fibrous structure exhibits a MD elongation to total foreshortening ratio of greater than 2.25 as measured according to the Elongation Test Method, is provided.

In another example of the present invention, a fibrous structure and/or sanitary tissue product comprising a fibrous structure, for example a through-air-dried fibrous structure and/or sanitary tissue product, comprising a fibrous structure comprising a plurality of pulp fibers and having a process induced foreshortening and/or wet microcontraction (WMC) of 0% or greater imparted to the fibrous structure, exhibits a MD elongation to total foreshortening (total process induced foreshortening) ratio of greater than 2.5 as measured according to the Elongation Test Method described herein, is provided.

In still another example of the present invention, a method for making a fibrous structure and/or sanitary tissue product comprising a fibrous structure according to the present invention, the method comprises the steps of:

a. providing a plurality of pulp fibers;
b. depositing the pulp fibers on a forming wire to form a fibrous structure; and
c. applying the fibrous structure to a through-air-drying member (for example a through-air-drying fabric and/or through-air-drying belt) such that non-semi-continuous knuckles (for example discrete and/or continuous knuckles) are imparted to the fibrous structure such that a sanitary tissue product made therefrom exhibits a MD elongation to total foreshortening (total process induced foreshortening) ratio of greater than 2.25 as measured according to the Elongation Test Method described herein, is provided.

In still another example of the present invention, a method for making a fibrous structure and/or sanitary tissue product comprising a fibrous structure according to the present invention, the method comprises the steps of:

a. providing a plurality of pulp fibers;
b. depositing the pulp fibers on a forming wire to form a fibrous structure; and
c. applying the fibrous structure to a through-air-drying member such that the fibrous structure is imparted a pattern of semi-continuous high density knuckle regions and a pattern of semi-continuous low density pillow regions, such that the fibrous structure exhibits a MD elongation to total foreshortening ratio of greater than 2.25 as measured according to the Elongation Test Method, is provided.

In yet another example of the present invention, a method for making a fibrous structure and/or a sanitary tissue product comprising a fibrous structure according to the present invention, the method comprises the steps of:

a. providing a plurality of pulp fibers;
b. depositing the pulp fibers on a forming wire to form a fibrous structure;
c. subjecting the fibrous structure to 0% or greater process induced foreshortening; and
d. applying the fibrous structure to a applying the fibrous structure to a through-air-drying member such that the fibrous structure exhibits a MD elongation to total foreshortening ratio of greater than 2.5 as measured according to the Elongation Test Method, is provided.

Accordingly, the present invention provides sanitary tissue products and methods for making such sanitary tissue products that exhibit consumer desired MD elongation to total foreshortening (total process induced foreshortening) ratios greater than those exhibited by known sanitary tissue products.

DETAILED DESCRIPTION OF THE INVENTION

Definitions

Figure 1:
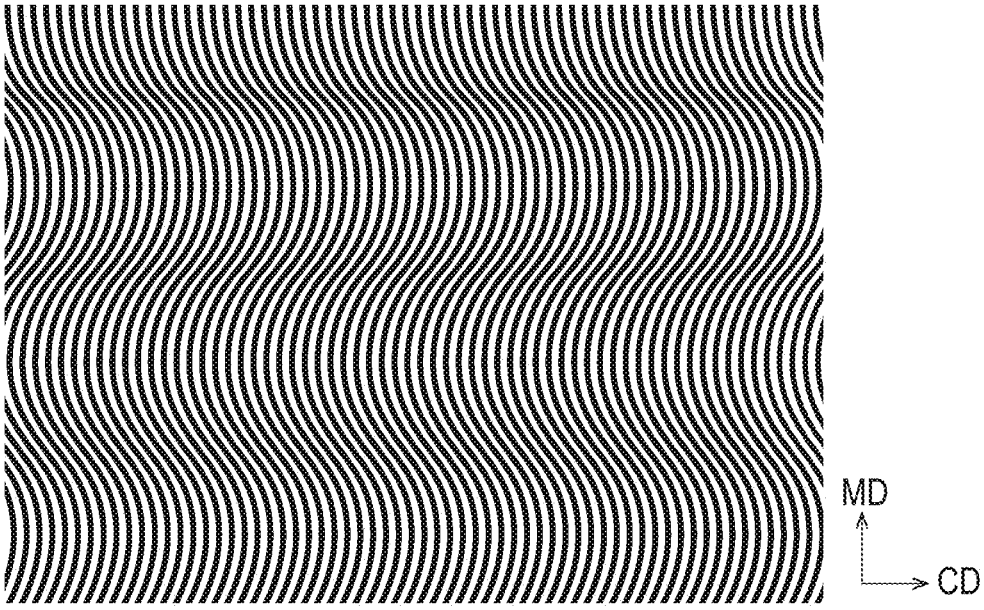
Fig. 1 Prior Art
FIG. 1 is a schematic representation of a prior art patterned through-air-drying belt.

"Sanitary tissue product" as used herein means a soft, low density (i.e. < about 0.15 g/cm$^3$) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

In one example, the sanitary tissue product of the present invention comprises a fibrous structure according to the present invention.

The sanitary tissue products and/or fibrous structures of the present invention may exhibit a basis weight of greater than 15 g/m$^2$ (9.2 lbs/3000 ft$^2$) to about 120 g/m$^2$ (73.8 lbs/3000 ft$^2$) and/or from about 15 g/m$^2$ (9.2 lbs/3000 ft$^2$) to about 110 g/m$^2$ (67.7 lbs/3000 ft$^2$) and/or from about 20 g/m$^2$ (12.3 lbs/3000 ft$^2$) to about 100 g/m$^2$ (61.5 lbs/3000 ft$^2$) and/or from about 30 (18.5 lbs/3000 ft$^2$) to 90 g/m$^2$ (55.4 lbs/3000 ft$^2$). In addition, the sanitary tissue products and/or fibrous structures of the present invention may exhibit a basis weight between about 40 g/m$^2$ (24.6 lbs/3000 ft$^2$) to about 120 g/m$^2$ (73.8 lbs/3000 ft$^2$) and/or from about 50 g/m$^2$ (30.8 lbs/3000 ft$^2$) to about 110 g/m$^2$ (67.7 lbs/3000 ft$^2$) and/or from about 55 g/m$^2$ (33.8 lbs/3000 ft$^2$) to about 105 g/m$^2$ (64.6 lbs/3000 ft$^2$) and/or from about 60 (36.9 lbs/3000 ft$^2$) to 100 g/m$^2$ (61.5 lbs/3000 ft$^2$).

The sanitary tissue products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present invention may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in).

In another example, the sanitary tissue products of the present invention may exhibit a total dry tensile strength of greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present invention may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present invention may exhibit an initial total wet tensile strength of greater than about 118 g/cm (300 g/in) and/or greater than about 157 g/cm (400 g/in) and/or greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

The sanitary tissue products of the present invention may exhibit a density (measured at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets.

In another example, the sanitary tissue products may be in the form of discrete sheets that are stacked within and dispensed from a container, such as a box.

The fibrous structures and/or sanitary tissue products of the present invention may comprises additives such as softening agents, temporary wet strength agents, permanent wet strength agents, bulk softening agents, lotion compositions, silicones, wetting agents, latexes, especially surface-pattern-applied latexes, dry strength agents such as carboxymethylcellulose and starch, and other types of additives suitable for inclusion in and/or on sanitary tissue products.

"Fibrous structure" as used herein means a structure that comprises a plurality of pulp fibers and optionally one or more filaments. In one example, a fibrous structure according to the present invention means an orderly arrangement of fibers alone and with filaments within a structure in order to perform a function. Non-limiting examples of fibrous structures of the present invention include paper.

Non-limiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

The fibrous structures of the present invention may be homogeneous or may be layered. If layered, the fibrous structures may comprise at least two and/or at least three and/or at least four and/or at least five layers.

In one example, the fibrous structure of the present invention consists essentially of fibers, for example pulp fibers, such as cellulosic pulp fibers.

In another example, the fibrous structure of the present invention comprises fibers and is void of filaments.

In another example, the fibrous structure of the present invention comprises filaments and is void of fibers.

In still another example, the fibrous structures of the present invention comprises filaments and fibers, such as a co-formed fibrous structure.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Fiber" and/or "Filament" as used herein means an elongate particulate having an apparent length greatly exceeding its apparent width, i.e. a length to diameter ratio of at least about 10. In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include pulp fibers, such as wood pulp fibers, and synthetic staple fibers such as polyester fibers.

Filaments are typically considered continuous or substantially continuous in nature. Filaments are relatively longer than fibers. Non-limiting examples of filaments include meltblown and/or spunbond filaments. Non-limiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In addition to the various wood pulp fibers, other cellulosic fibers such as cotton linters, rayon, lyocell, trichomes, seed hairs, and bagasse can be used in this invention. Other sources of cellulose in the form of fibers or capable of being spun into fibers include grasses and grain sources.

"Basis Weight" as used herein is the weight per unit area of a sample reported in lbs/3000 ft$^2$ or g/m$^2$ (gsm) and is measured according to the Basis Weight Test Method described herein described herein.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

"Surface pattern" with respect to a fibrous structure and/or sanitary tissue product in accordance with the present invention means herein a pattern that is present on at least one surface of the fibrous structure and/or sanitary tissue product. The surface pattern may be a textured surface pattern such that the surface of the fibrous structure and/or sanitary tissue product comprises protrusions and/or depressions as part of the surface pattern. For example, the surface pattern may comprise embossment line elements and/or wet textured line elements. The surface pattern may be a non-textured surface pattern such that the surface of the fibrous structure and/or sanitary tissue product does not comprise protrusions and/or depressions as part of the surface pattern. For example, the surface pattern may be printed on a surface of the fibrous structure and/or sanitary tissue product.

"3D pattern" with respect to a fibrous structure and/or sanitary tissue product's surface in accordance with the present invention means herein a pattern that is present on at least one surface of the fibrous structure and/or sanitary tissue product. The 3D pattern texturizes the surface of the fibrous structure and/or sanitary tissue product, for example by providing the surface with protrusions and/or depressions. The 3D pattern on the surface of the fibrous structure and/or sanitary tissue product is made by making the sanitary tissue product or at least one fibrous structure ply employed in the sanitary tissue product on a patterned molding member that imparts the 3D pattern to the sanitary tissue products and/or fibrous structure plies made thereon. For example, the 3D pattern may comprise a series of line elements, such as a series of line elements that are substantially oriented in the cross-machine direction of the fibrous structure and/or sanitary tissue product.

"Line element" as used herein means a portion of a fibrous structure's surface being in the shape of a line, which may be continuous, discrete, interrupted, and/or partial line with respect to a fibrous structure on which it is present. The line element may be of any suitable shape such as straight, bent, kinked, curled, curvilinear, serpentine, sinusoidal and mixtures thereof, that may form regular or irregular periodic or non-periodic lattice work of structures wherein the line element exhibits a length along its path of at least 2 mm and/or at least 4 mm and/or at least 6 mm and/or at least 1 cm to about 30 cm and/or to about 27 cm and/or to about 20 cm and/or to about 15 cm and/or to about 10.16 cm and/or to about 8 cm and/or to about 6 cm and/or to about 4 cm. In one example, the line element may comprise a plurality of discrete elements, such as dots and/or dashes for example, that are oriented together to form a line element of the present invention. In another example, the line element may comprise a combination of line segments and discrete elements, such as dots and/or dashes for example, that are oriented together to form a line element of the present invention.

The line element may exhibit an aspect ratio of greater than 1.5:1 and/or greater than 1.75:1 and/or greater than 2:1 and/or greater than 5:1 along the path of the line element. In one example, the line element exhibits a length along its path of at least 2 mm and/or at least 4 mm and/or at least 6 mm and/or at least 1 cm to about 30 cm and/or to about 27 cm and/or to about 20 cm and/or to about 15 cm and/or to about 10.16 cm and/or to about 8 cm and/or to about 6 cm and/or to about 4 cm.

Different line elements may exhibit different common intensive properties. For example, different line elements may exhibit different densities and/or basis weights. In one example, a fibrous structure of the present invention comprises a first series of line elements and a second series of line elements. For example, the line elements of the first series of line elements may exhibit the same densities, which are lower than the densities of the line elements of the second series of line elements. In another example, the line elements of the first series of line elements may exhibit the same elevations, which are higher than the elevations of the line elements of the second series of line elements. In another example, the line elements of the first series of line elements may exhibit the same basis weights, which are lower than the basis weights of the line elements of the second series of line elements.

In one example, the line element is a straight or substantially straight line element. In another example, the line element is a curvilinear line element, such as a sinusoidal line element. Unless otherwise stated, the line elements of the present invention are present on a surface of a fibrous structure In one example, the line element and/or line element forming component is continuous or substantially continuous within a fibrous structure, for example in one case one or more 11 cm×11 cm sheets of fibrous structure.

The line elements may exhibit different widths along their lengths of their paths, between two or more different line elements and/or the line elements may exhibit different lengths. Different line elements may exhibit different widths and/or lengths along their respective paths.

In one example, the surface pattern of the present invention comprises a plurality of parallel line elements. The plurality of parallel line elements may be a series of parallel line elements. In one example, the plurality of parallel line elements may comprise a plurality of parallel sinusoidal line elements.

"Embossed" as used herein with respect to a fibrous structure and/or sanitary tissue product means that a fibrous structure and/or sanitary tissue product has been subjected to a process which converts a smooth surfaced fibrous structure and/or sanitary tissue product to a decorative surface by replicating a design on one or more emboss rolls, which form a nip through which the fibrous structure and/or sanitary tissue product passes. Embossed does not include creping, microcreping, printing or other processes that may also impart a texture and/or decorative pattern to a fibrous structure and/or sanitary tissue product.

In one example, the line elements of the present invention may comprise wet texture, such as being formed by wet molding and/or through-air-drying via a fabric and/or an imprinted through-air-drying fabric. In one example, the wet texture line elements are water-resistant.

"Water-resistant" as it refers to a surface pattern or part thereof means that a line element and/or pattern comprising the line element retains its structure and/or integrity after being saturated by water and the line element and/or pattern is still visible to a consumer. In one example, the line elements and/or pattern may be water-resistant.

"Discrete" as it refers to a line element means that a line element has at least one immediate adjacent region of the fibrous structure that is different from the line element. In one example, a plurality of parallel line elements are discrete and/or separated from adjacent parallel line elements by a channel. The channel may exhibit a complementary shape to the parallel line elements. In other words, if the plurality of parallel line elements are straight lines, then the channels separating the parallel line elements would be straight. Likewise, if the plurality of parallel line elements are sinusoidal lines, then the channels separating the parallel line elements would be sinusoidal. The channels may exhibit the same widths and/or lengths as the line elements.

"Machine direction oriented" as it refers to a line element a line element means that the line element has a primary direction that is at an angle of less than 45° and/or less than 30° and/or less than 15° and/or less than 5° and/or to about 0° with respect to the machine direction of the 3D patterned fibrous structure ply and/or sanitary tissue product comprising the 3D patterned fibrous structure ply.

"Substantially cross machine direction oriented" as it refers to a line element and/or series of line elements means that the line element and/or series of line elements has a primary direction that is at an angle of less than 20° and/or less than 15° and/or less than 10° and/or less than 5° and/or to about 0° with respect to the cross-machine direction of the 3D patterned fibrous structure ply and/or sanitary tissue product comprising the 3D patterned fibrous structure ply. In one example, the line element and/or series of line elements has a primary direction that is an angle of from about 3° to about 0° with respect to the cross-machine direction of the 3D patterned fibrous structure ply and/or sanitary tissue product comprising the 3D patterned fibrous structure ply.

"Wet textured" as used herein means that a 3D patterned fibrous structure ply comprises texture (for example a three-dimensional topography) imparted to the fibrous structure and/or fibrous structure's surface during a fibrous structure making process. In one example, in a wet-laid fibrous structure making process, wet texture can be imparted to a fibrous structure upon fibers and/or filaments being collected on a collection device that has a three-dimensional (3D) surface which imparts a 3D surface to the fibrous structure being formed thereon and/or being transferred to a fabric and/or belt, such as a through-air-drying fabric and/or a patterned drying belt, comprising a 3D surface that imparts a 3D surface to a fibrous structure being formed thereon. In one example, the collection device with a 3D surface comprises a patterned, such as a patterned formed by a polymer or resin being deposited onto a base substrate, such as a fabric, in a patterned configuration. The wet texture imparted to a wet-laid fibrous structure is formed in the fibrous structure prior to and/or during drying of the fibrous structure. Non-limiting examples of collection devices and/or fabric and/or belts suitable for imparting wet texture to a fibrous structure include those fabrics and/or belts used in fabric creping and/or belt creping processes, for example as disclosed in U.S. Pat. Nos. 7,820,008 and 7,789,995, coarse through-air-drying fabrics as used in uncreped through-air-drying processes, and photo-curable resin patterned through-air-drying belts, for example as disclosed in U.S. Pat. No. 4,637,859. For purposes of the present invention, the collection devices used for imparting wet texture to the fibrous structures would be patterned to result in the fibrous structures comprising a surface pattern comprising a plurality of parallel line elements wherein at least one, two, three, or more, for example all of the parallel line elements exhibit a non-constant width along the length of the parallel line elements. This is different from non-wet texture that is imparted to a fibrous structure after the fibrous structure has been dried, for example after the moisture level of the fibrous structure is less than 15% and/or less than 10% and/or less than 5%. An example of non-wet texture includes embossments imparted to a fibrous structure by embossing rolls during converting of the fibrous structure.

"Non-rolled" as used herein with respect to a fibrous structure and/or sanitary tissue product of the present invention means that the fibrous structure and/or sanitary tissue product is an individual sheet (for example not connected to adjacent sheets by perforation lines. However, two or more individual sheets may be interleaved with one another) that is not convolutedly wound about a core or itself. For example, a non-rolled product comprises a facial tissue.

"Creped" as used herein means creped off of a Yankee dryer or other similar roll and/or fabric creped and/or belt creped. Rush transfer of a fibrous structure alone does not result in a "creped" fibrous structure or "creped" sanitary tissue product for purposes of the present invention.

Sanitary Tissue Product

The sanitary tissue products of the present invention may be single-ply or multi-ply sanitary tissue products. In other words, the sanitary tissue products of the present invention may comprise one or more fibrous structures. In one example, the fibrous structures and/or sanitary tissue products of the present invention are made from a plurality of pulp fibers, for example wood pulp fibers and/or other cellulosic pulp fibers, for example trichomes. In addition to the pulp fibers, the fibrous structures and/or sanitary tissue products of the present invention may comprise synthetic fibers and/or filaments.

The fibrous structures and/or sanitary tissue products of the present invention may be creped or uncreped.

The fibrous structures and/or sanitary tissue products of the present invention may be wet-laid or air-laid.

The fibrous structures and/or sanitary tissue products of the present invention may be embossed.

The fibrous structures and/or sanitary tissue products of the present invention may comprise a surface softening agent or be void of a surface softening agent. In one example, the sanitary tissue product is a non-lotioned sanitary tissue product.

The fibrous structures and/or sanitary tissue products of the present invention may comprise trichome fibers and/or may be void of trichome fibers.

The fibrous structures and/or sanitary tissue products of the present invention may exhibit the compressibility values alone or in combination with the plate stiffness values with or without the aid of surface softening agents. In other words, the sanitary tissue products of the present invention may exhibit the compressibility values described above alone or in combination with the plate stiffness values when surface softening agents are not present on and/or in the sanitary tissue products, in other words the sanitary tissue product is void of surface softening agents. This does not mean that the sanitary tissue products themselves cannot include surface softening agents. It simply means that when the sanitary tissue product is made without adding the surface softening agents, the sanitary tissue product exhibits the compressibility and plate stiffness values of the present invention. Addition of a surface softening agent to such a sanitary tissue product within the scope of the present invention (without the need of a surface softening agent or other chemistry) may enhance the sanitary tissue product's compressibility and/or plate stiffness to an extent. However, sanitary tissue products that need the inclusion of surface softening agents on and/or in them to be within the scope of the present invention, in other words to achieve the compressibility and plate stiffness values of the present invention, are outside the scope of the present invention.

In one example, a fibrous structure comprising a plurality of pulp fibers, wherein the fibrous structure is void of a continuous knuckle and wherein the fibrous structure exhibits a MD elongation to total foreshortening ratio of greater than 2.25 and/or greater than 2.3 and/or greater than 2.5 and/or greater than 2.75 and/or greater than 3 as measured according to the Elongation Test Method.

The fibrous structure of the present invention may exhibit differential density. For example, the fibrous structure may exhibit low density pillow regions and high density knuckle regions. In one example, the fibrous structure exhibits high density knuckle regions present in a continuous network pattern and low density pillow regions present as discrete regions. In another example, the fibrous structure exhibits high density knuckle regions present in a semi-continuous pattern and low density pillow regions present in a semi-continuous pattern.

In one example, a plurality of the high density knuckle regions of the fibrous structure are oriented substantially in the cross-machine direction, such as at less than 20° and/or at 10° or less and/or at 5° or less and/or at 3° or less and/or at about 0° from the cross-machine direction axis of the fibrous structure.

In one example, a plurality of the high density knuckle regions comprise curvilinear lines. In another example, a plurality of the high density knuckle regions comprise sinusoidal lines.

One or more fibrous structures of the present invention may be used to make a single- or multi-ply sanitary tissue product of the present invention.

Table 1 below shows comparative fibrous structures and/or sanitary tissue products that exhibit MD elongation to total foreshortening ratios outside the scope of the present invention.

| Condition | forming speed | reel speed | Overall Crepe % | MD Elongation (%) | MD %/TFS % |
|---|---|---|---|---|---|
| P&G Comparative Example | | | −12.00 | 23.00 | 1.92 |
| P&G Comparative Example | 2475.00 | 2106.00 | −14.91 | 23.00 | 1.54 |
| P&G Comparative Example | 2537.95 | 2156.58 | −15.03 | 23.33 | 1.55 |
| P&G Comparative Example | 3512.77 | 2812.06 | −19.95 | 26.24 | 1.32 |
| P&G Comparative Example) | 799.80 | 650.00 | −18.73 | 34.80 | 1.86 |

Table 2 below shows comparative fibrous structure and/or sanitary tissue products that exhibit MD elongation to total foreshortening ratios outside the scope of the present invention.

| Condition | WMC % | Overall Crepe % | Total Foreshortening (TFS) % (WMC + Overall Crepe) | MD Elongation (%) | MD Elongation %/TFS % |
|---|---|---|---|---|---|
| Bounty 2009 | 0.00 | 6.50 | 6.50 | 14.80 | 2.28 |
| Bounty 2012 | 15.50 | −5.50 | 10.00 | 13.07 | 1.31 |
| Bounty | 3.50 | 7.00 | 10.50 | 14.00 | 1.33 |
| Bounty | 3.50 | 7.00 | 10.50 | 15.90 | 1.51 |
| Bounty Rinse | −1.50 | 4.00 | 2.50 | 12.90 | 5.16 |
| & Reuse | 2.00 | 4.00 | 6.00 | 12.90 | 2.15 |
| Bounty | 3.50 | 7.00 | 10.50 | 15.99 | 1.52 |
| Bounty | −1.50 | 4.00 | 2.50 | 10.00 | 4.00 |
| | 2.00 | 4.00 | 6.00 | 10.00 | 1.67 |
| Bounty | −1.50 | 4.00 | 2.50 | 13.50 | 5.40 |
| | 2.00 | 4.00 | 6.00 | 13.50 | 2.25 |
| Bounty Rinse | −1.50 | 4.00 | 2.50 | 14.60 | 5.84 |
| & Reuse | 2.00 | 4.00 | 6.00 | 14.60 | 2.43 |
| Bounty | 3.00 | 6.50 | 9.50 | 19.18 | 2.02 |
| Bounty | −1.50 | 7.50 | 6.00 | 17.60 | 2.93 |

Patterned Molding Members

The sanitary tissue products of the present invention and/or fibrous structure plies employed in the sanitary tissue products of the present invention are formed on patterned molding members, for example through-air-drying members such as through-air-drying fabrics and/or through-air-drying belts, that result in the fibrous structures and/or sanitary tissue products of the present invention. In one example, the pattern molding member comprises a non-random repeating pattern. In another example, the pattern molding member comprises a resinous pattern.

A "reinforcing element" may be a desirable (but not necessary) element in some examples of the molding member, serving primarily to provide or facilitate integrity, stability, and durability of the molding member comprising, for example, a resinous material. The reinforcing element can be fluid-permeable or partially fluid-permeable, may have a variety of embodiments and weave patterns, and may comprise a variety of materials, such as, for example, a plurality of interwoven yarns (including Jacquard-type and the like woven patterns), a felt, a plastic, other suitable synthetic material, or any combination thereof.

Figure 2A:
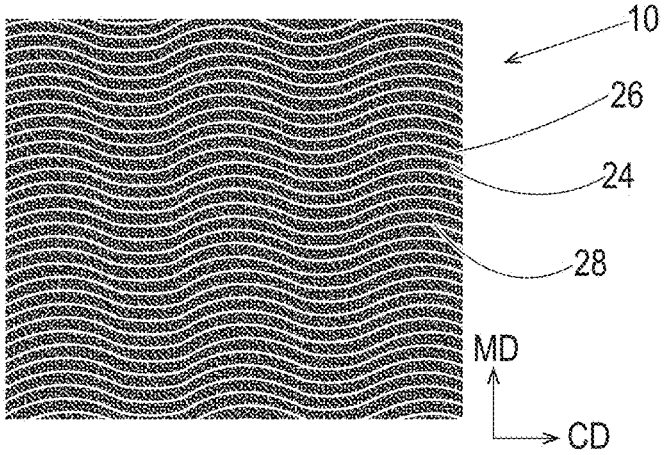
FIG. 2A is a schematic representation of an example of a molding member (for example a through-air-drying member) according to the present invention.
Figure 2B:
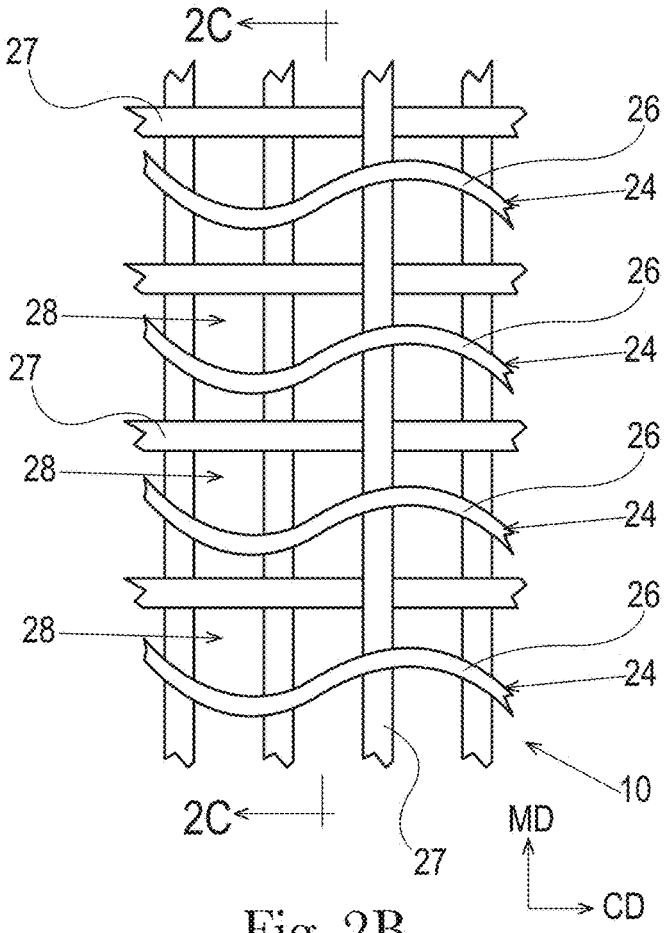
FIG. 2B is a further schematic representation of a portion of the molding member of FIG. 2A.
Figure 3A:
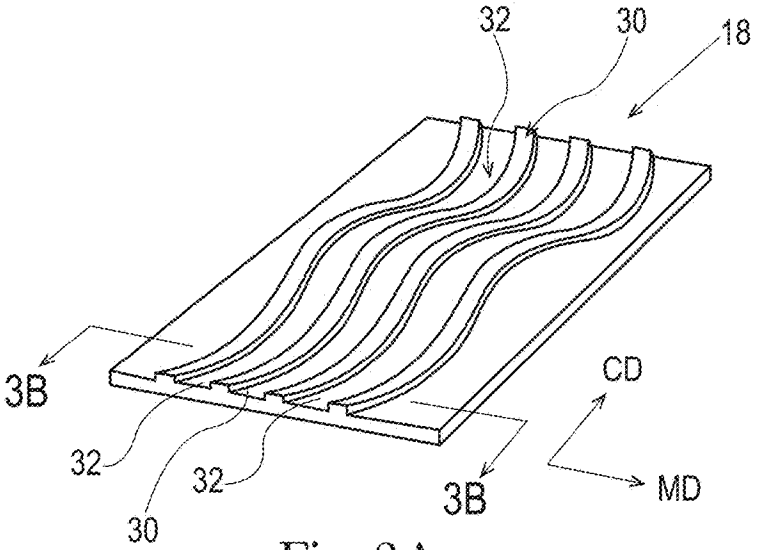
FIG. 3A is a schematic representation of a sanitary tissue product made using the molding member of FIG. 2A.
Figure 3B:
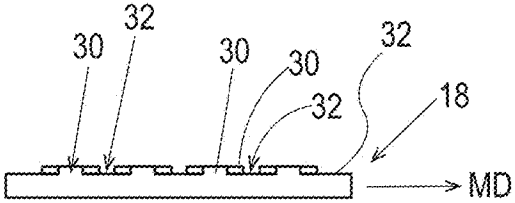
FIG. 3B is a cross-sectional view of FIG. 3A taken along line 3B-3B.
Figure 2C:
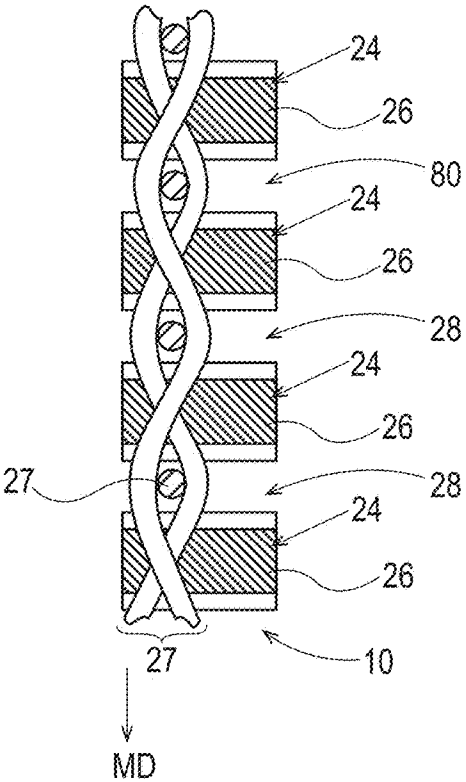
FIG. 2C is a cross-sectional view of FIG. 2B taken along line 2C-2C.
Figure 3C:
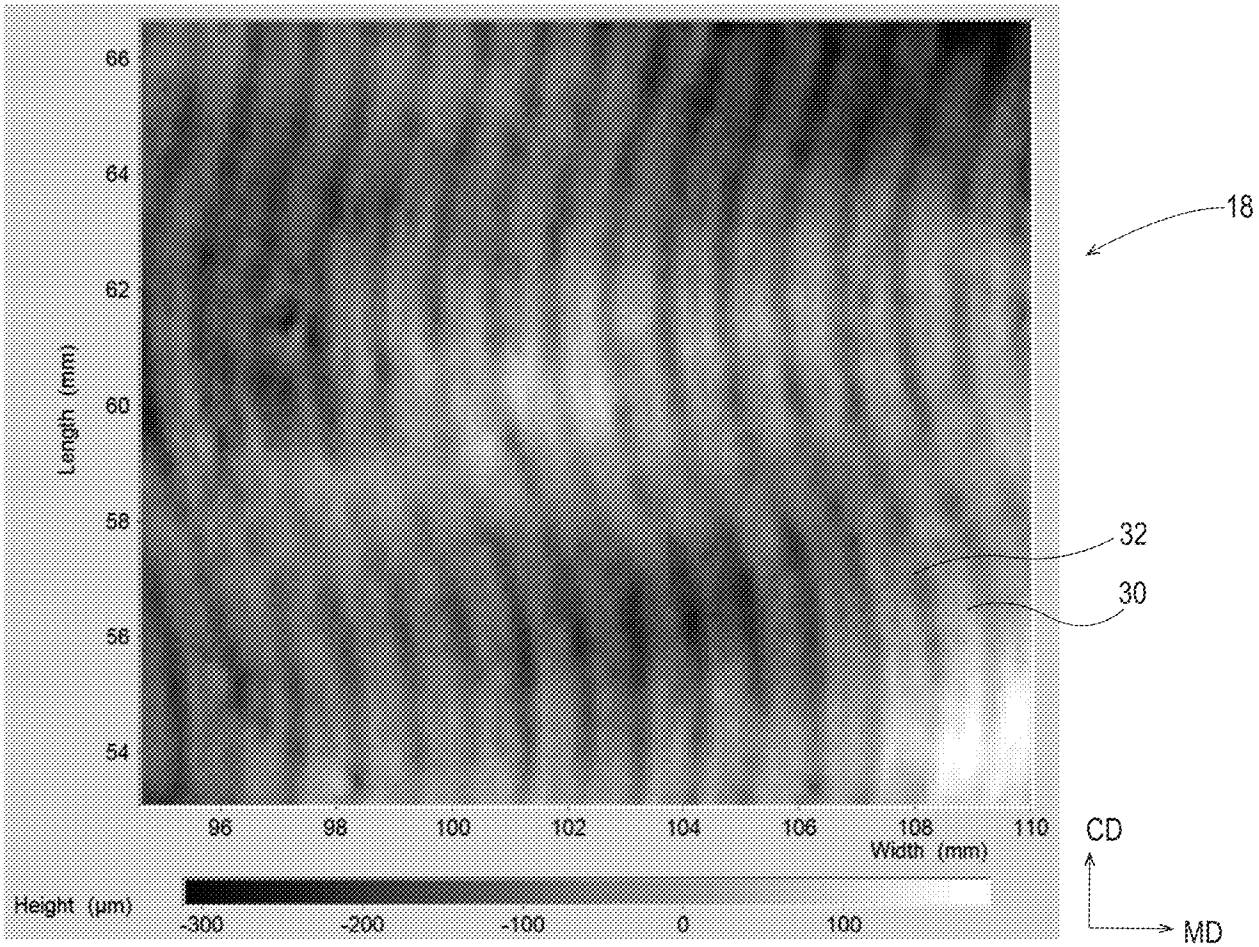
FIG. 3C is a MikroCAD image of a sanitary tissue product made using the molding member of FIG. 2A.
Figure 3D:
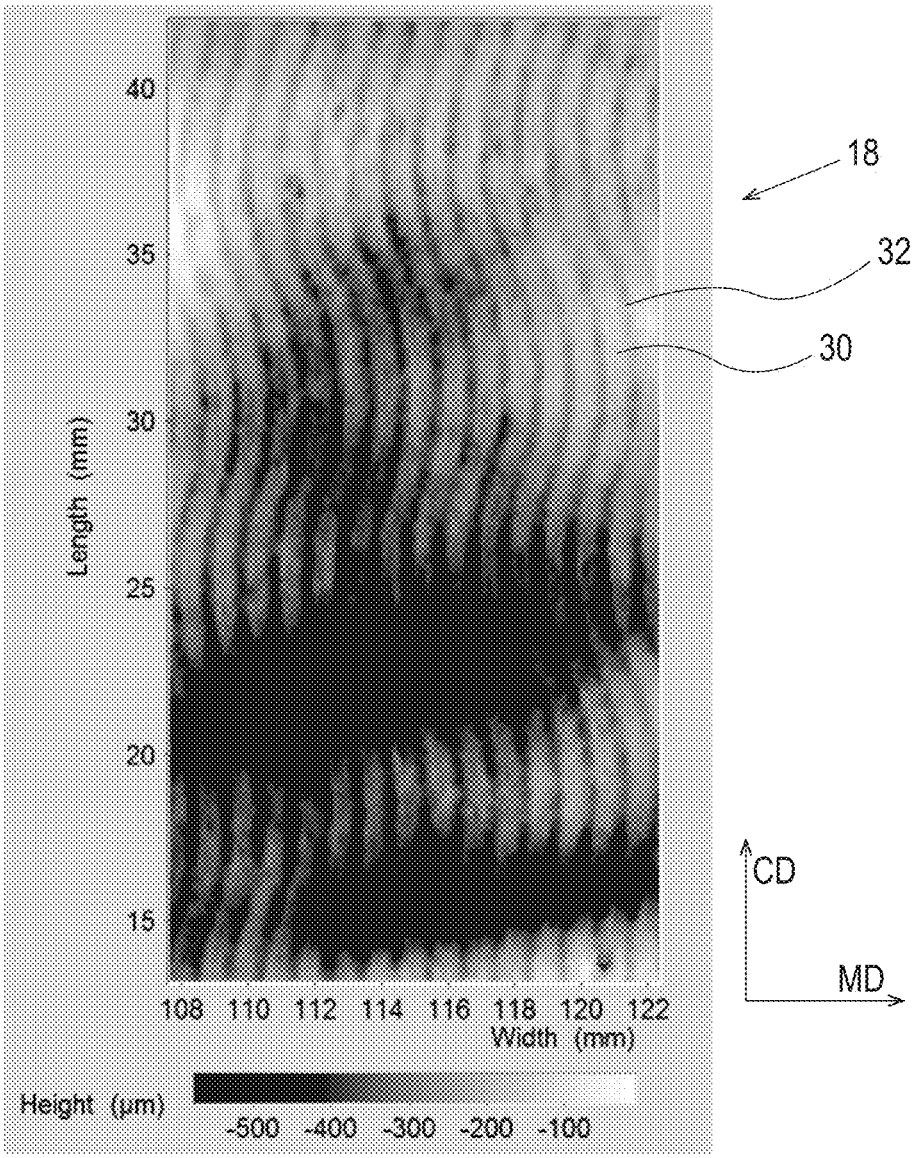
FIG. 3D is a magnified portion of the MikroCAD image of FIG. 3C.

As shown in FIGS. 2A-2C, a non-limiting example of a patterned molding member suitable for use in the present invention comprises a through-air-drying belt 10. The through-air-drying belt 10 comprises a plurality of semi-continuous knuckles 24 formed by semi-continuous line segments of resin 26 arranged in a non-random, repeating pattern, for example a substantially cross-machine direction repeating pattern of semi-continuous lines supported on a support fabric comprising filaments 27. In this case, the semi-continuous lines are curvilinear, for example sinusoidal. The semi-continuous knuckles 24 are spaced from adjacent semi-continuous knuckles 24 by semi-continuous pillows 28, which constitute deflection conduits into which portions of a fibrous structure ply being made on the through-air-drying belt 10 of FIGS. 2A-2C deflect. As shown in FIGS. 3A and 3B, a resulting sanitary tissue product 18 being made on the through-air-drying belt 10 of FIGS. 2A-2C comprises semi-continuous pillow regions 30 imparted by the semi-continuous pillows 28 of the through-air-drying belt 10 of FIGS. 2A-2C. The sanitary tissue product 18 further comprises semi-continuous knuckle regions 32 imparted by the semi-continuous knuckles 24 of the through-air-drying belt 10 of FIGS. 2A-2C. The semi-continuous pillow regions 30 and semi-continuous knuckle regions 32 may exhibit different densities, for example, one or more of the semi-continuous knuckle regions 32 may exhibit a density that is greater than the density of one or more of the semi-continuous pillow regions 30.

Without wishing to be bound by theory, foreshortening (dry & wet crepe, fabric crepe, rush transfer, etc) is an integral part of fibrous structure and/or sanitary tissue paper making, helping to produce the desired balance of strength, stretch, softness, absorbency, etc. Fibrous structure support, transport and molding members used in the papermaking process, such as rolls, wires, felts, fabrics, belts, etc. have been variously engineered to interact with foreshortening to further control the fibrous structure and/or sanitary tissue product properties. In the past, it has been thought that it is advantageous to avoid highly CD dominant knuckle designs that result in MD oscillations of foreshortening forces. However, it has unexpectedly been found that the molding member of FIGS. 2A-2C provides patterned molding member having CD dominant semi-continuous knuckles that to enable better control of the fibrous structure's molding and stretch while overcoming the negatives of the past.

Non-Limiting Examples of Making Sanitary Tissue Products

The sanitary tissue products of the present invention may be made by any suitable papermaking process so long as a molding member of the present invention is used to making the sanitary tissue product or at least one fibrous structure ply of the sanitary tissue product and that the sanitary tissue product exhibits a compressibility and plate stiffness values of the present invention. The method may be a sanitary tissue product making process that uses a cylindrical dryer such as a Yankee (a Yankee-process) or it may be a Yankeeless process as is used to make substantially uniform density and/or uncreped fibrous structures and/or sanitary tissue products. Alternatively, the fibrous structures and/or sanitary tissue products may be made by an air-laid process and/or meltblown and/or spunbond processes and any combinations thereof so long as the fibrous structures and/or sanitary tissue products of the present invention are made thereby.

Figure 4:
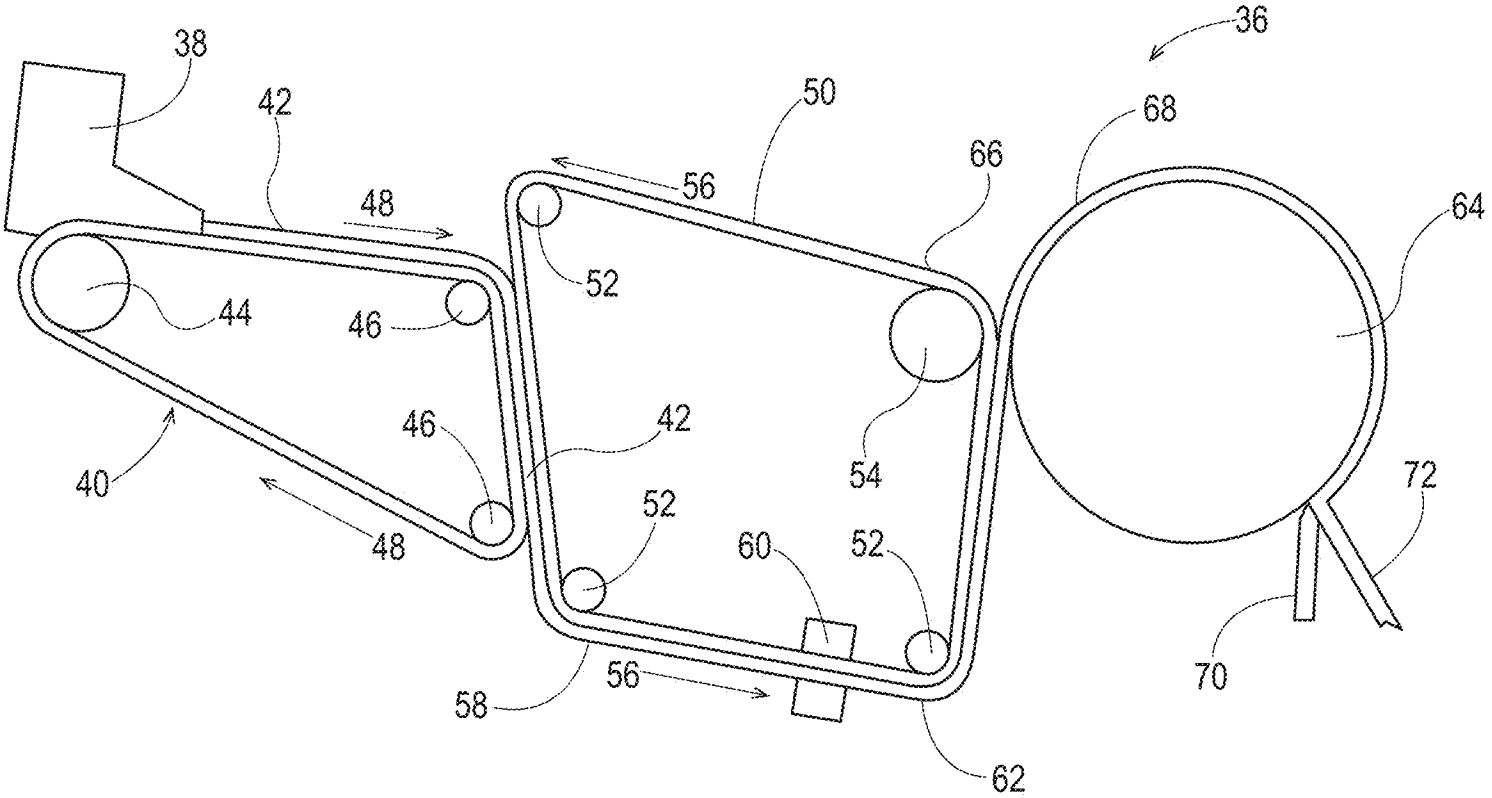
FIG. 4 is a schematic representation of an example of a through-air-drying papermaking process for making a sanitary tissue product according to the present invention.

As shown in FIG. 4, one example of a process and equipment, represented as 36 for making a sanitary tissue product according to the present invention comprises supplying an aqueous dispersion of fibers (a fibrous furnish or fiber slurry) to a headbox 38 which can be of any convenient design. From headbox 38 the aqueous dispersion of fibers is delivered to a first foraminous member 40 which is typically a Fourdrinier wire, to produce an embryonic fibrous structure 42.

The first foraminous member 40 may be supported by a breast roll 44 and a plurality of return rolls 46 of which only two are shown. The first foraminous member 40 can be propelled in the direction indicated by directional arrow 48 by a drive means, not shown. Optional auxiliary units and/or devices commonly associated fibrous structure making machines and with the first foraminous member 40, but not shown, include forming boards, hydrofoils, vacuum boxes, tension rolls, support rolls, wire cleaning showers, and the like.

After the aqueous dispersion of fibers is deposited onto the first foraminous member 40, embryonic fibrous structure 42 is formed, typically by the removal of a portion of the aqueous dispersing medium by techniques well known to those skilled in the art. Vacuum boxes, forming boards, hydrofoils, and the like are useful in effecting water removal. The embryonic fibrous structure 42 may travel with the first foraminous member 40 about return roll 46 and is brought into contact with a patterned molding member 50, such as a 3D patterned through-air-drying belt. While in contact with the patterned molding member 50, the embryonic fibrous structure 42 will be deflected, rearranged, and/or further dewatered. This can be accomplished by applying differential speeds and/or pressures.

The patterned molding member 50 may be in the form of an endless belt. In this simplified representation, the patterned molding member 50 passes around and about patterned molding member return rolls 52 and impression nip roll 54 and may travel in the direction indicated by directional arrow 56. Associated with patterned molding member 50, but not shown, may be various support rolls, other return rolls, cleaning means, drive means, and the like well known to those skilled in the art that may be commonly used in fibrous structure making machines.

After the embryonic fibrous structure 42 has been associated with the patterned molding member 50, fibers within the embryonic fibrous structure 42 are deflected into pillows and/or pillow network ("deflection conduits") present in the patterned molding member 50. In one example of this process step, there is essentially no water removal from the embryonic fibrous structure 42 through the deflection conduits after the embryonic fibrous structure 42 has been associated with the patterned molding member 50 but prior to the deflecting of the fibers into the deflection conduits. Further water removal from the embryonic fibrous structure 42 can occur during and/or after the time the fibers are being deflected into the deflection conduits. Water removal from the embryonic fibrous structure 42 may continue until the consistency of the embryonic fibrous structure 42 associated with patterned molding member 50 is increased to from about 25% to about 35%. Once this consistency of the embryonic fibrous structure 42 is achieved, then the embryonic fibrous structure 42 can be referred to as an intermediate fibrous structure 58. During the process of forming the embryonic fibrous structure 42, sufficient water may be removed, such as by a noncompressive process, from the embryonic fibrous structure 42 before it becomes associated with the patterned molding member 50 so that the consistency of the embryonic fibrous structure 42 may be from about 10% to about 30%.

While applicants decline to be bound by any particular theory of operation, it appears that the deflection of the fibers in the embryonic fibrous structure and water removal from the embryonic fibrous structure begin essentially simultaneously. Embodiments can, however, be envisioned wherein deflection and water removal are sequential operations. Under the influence of the applied differential fluid pressure, for example, the fibers may be deflected into the deflection conduit with an attendant rearrangement of the fibers. Water removal may occur with a continued rearrangement of fibers. Deflection of the fibers, and of the embryonic fibrous structure, may cause an apparent increase in surface area of the embryonic fibrous structure. Further, the rearrangement of fibers may appear to cause a rearrangement in the spaces or capillaries existing between and/or among fibers.

It is believed that the rearrangement of the fibers can take one of two modes dependent on a number of factors such as, for example, fiber length. The free ends of longer fibers can be merely bent in the space defined by the deflection conduit while the opposite ends are restrained in the region of the ridges. Shorter fibers, on the other hand, can actually be transported from the region of the ridges into the deflection conduit (The fibers in the deflection conduits will also be rearranged relative to one another). Naturally, it is possible for both modes of rearrangement to occur simultaneously.

As noted, water removal occurs both during and after deflection; this water removal may result in a decrease in fiber mobility in the embryonic fibrous structure. This decrease in fiber mobility may tend to fix and/or freeze the fibers in place after they have been deflected and rearranged. Of course, the drying of the fibrous structure in a later step in the process of this invention serves to more firmly fix and/or freeze the fibers in position.

Any convenient means conventionally known in the papermaking art can be used to dry the intermediate fibrous structure 58. Examples of such suitable drying process include subjecting the intermediate fibrous structure 58 to conventional and/or flow-through dryers and/or Yankee dryers.

In one example of a drying process, the intermediate fibrous structure 58 in association with the patterned molding member 50 passes around the patterned molding member return roll 52 and travels in the direction indicated by directional arrow 56. The intermediate fibrous structure 58 may first pass through an optional predryer 60. This predryer 60 can be a conventional flow-through dryer (hot air dryer) well known to those skilled in the art. Optionally, the predryer 60 can be a so-called capillary dewatering apparatus. In such an apparatus, the intermediate fibrous structure 58 passes over a sector of a cylinder having preferential-capillary-size pores through its cylindrical-shaped porous cover. Optionally, the predryer 60 can be a combination capillary dewatering apparatus and flow-through dryer. The quantity of water removed in the predryer 60 may be controlled so that a predried fibrous structure 62 exiting the predryer 60 has a consistency of from about 30% to about 98%. The predried fibrous structure 62, which may still be associated with patterned molding member 50, may pass around another patterned molding member return roll 52 and as it travels to an impression nip roll 54. As the predried fibrous structure 62 passes through the nip formed between impression nip roll 54 and a surface of a Yankee dryer 64, the pattern formed by the top surface 66 of patterned molding member 50 is impressed into the predried fibrous structure 62 to form a 3D patterned fibrous structure 68. The imprinted fibrous structure 68 can then be adhered to the surface of the Yankee dryer 64 where it can be dried to a consistency of at least about 95%.

The 3D patterned fibrous structure 68 can then be foreshortened by creping the 3D patterned fibrous structure 68 with a creping blade 70 to remove the 3D patterned fibrous structure 68 from the surface of the Yankee dryer 64 resulting in the production of a 3D patterned creped fibrous structure 72 in accordance with the present invention. As used herein, foreshortening refers to the reduction in length of a dry (having a consistency of at least about 90% and/or at least about 95%) fibrous structure which occurs when energy is applied to the dry fibrous structure in such a way that the length of the fibrous structure is reduced and the fibers in the fibrous structure are rearranged with an accompanying disruption of fiber-fiber bonds. Foreshortening can be accomplished in any of several well-known ways. One common method of foreshortening is creping. The 3D patterned creped fibrous structure 72 may be subjected to post processing steps such as calendaring, tuft generating operations, and/or embossing and/or converting.

Figure 5:
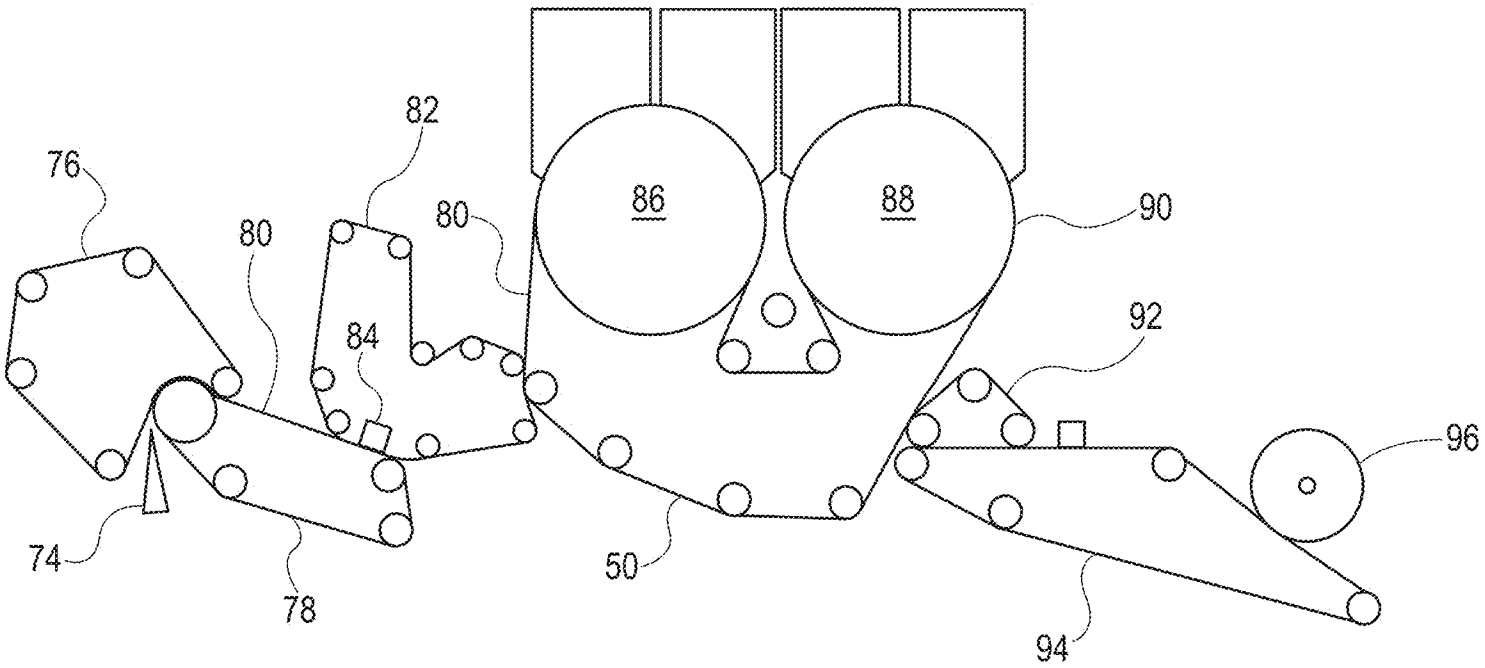
FIG. 5 is a schematic representation of an example of an uncreped through-air-drying papermaking process for making a sanitary tissue product according to the present invention.

Another example of a suitable papermaking process for making the sanitary tissue products of the present invention is illustrated in FIG. 5. FIG. 5 illustrates an uncreped through-air-drying process. In this example, a multi-layered headbox 74 deposits an aqueous suspension of papermaking fibers between forming wires 76 and 78 to form an embryonic fibrous structure 80. The embryonic fibrous structure 80 is transferred to a slower moving transfer fabric 82 with the aid of at least one vacuum box 84. The level of vacuum used for the fibrous structure transfers can be from about 3 to about 15 inches of mercury (76 to about 381 millimeters of mercury). The vacuum box 84 (negative pressure) can be supplemented or replaced by the use of positive pressure from the opposite side of the embryonic fibrous structure 80 to blow the embryonic fibrous structure 80 onto the next fabric in addition to or as a replacement for sucking it onto the next fabric with vacuum. Also, a vacuum roll or rolls can be used to replace the vacuum box(es) 84.

The embryonic fibrous structure 80 is then transferred to a molding member 50 of the present invention, such as a through-air-drying fabric, and passed over through-air-dryers 86 and 88 to dry the embryonic fibrous structure 80 to form a 3D patterned fibrous structure 90. While supported by the molding member 50, the 3D patterned fibrous structure 90 is finally dried to a consistency of about 94% percent or greater. After drying, the 3D patterned fibrous structure 90 is transferred from the molding member 50 to fabric 92 and thereafter briefly sandwiched between fabrics 92 and 94. The dried 3D patterned fibrous structure 90 remains with fabric 94 until it is wound up at the reel 96 ("parent roll") as a finished fibrous structure. Thereafter, the finished 3D patterned fibrous structure 90 can be unwound, calendered and converted into the sanitary tissue product of the present invention, such as a roll of bath tissue, in any suitable manner.

Figure 6:
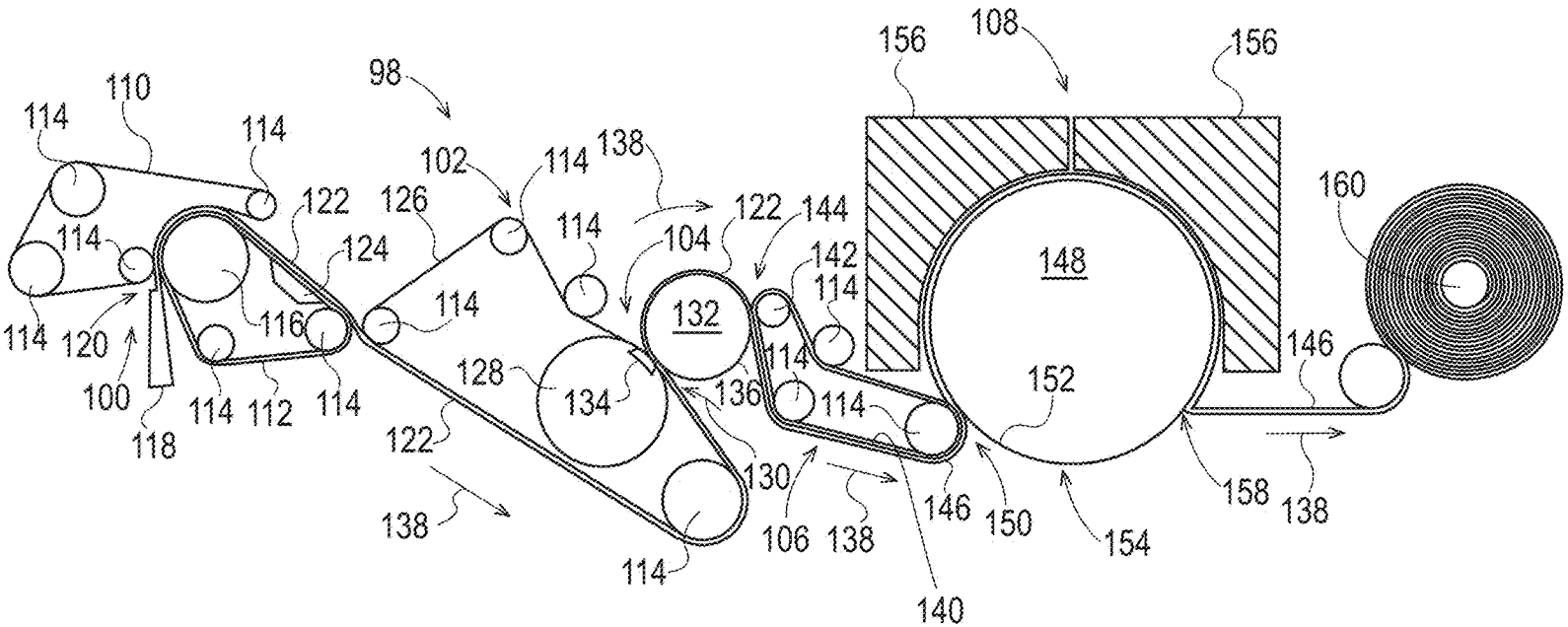
FIG. 6 is a schematic representation of an example of fabric creped papermaking process for making a sanitary tissue product according to the present invention.

Yet another example of a suitable papermaking process for making the sanitary tissue products of the present invention is illustrated in FIG. 6. FIG. 6 illustrates a papermaking machine 98 having a conventional twin wire forming section 100, a felt run section 102, a shoe press section 104, a molding member section 106, in this case a creping fabric section, and a Yankee dryer section 108 suitable for practicing the present invention. Forming section 100 includes a pair of forming fabrics 110 and 112 supported by a plurality of rolls 114 and a forming roll 116. A headbox 118 provides papermaking furnish to a nip 120 between forming roll 116 and roll 114 and the fabrics 110 and 112. The furnish forms an embryonic fibrous structure 122 which is dewatered on the fabrics 110 and 112 with the assistance of vacuum, for example, by way of vacuum box 124.

The embryonic fibrous structure 122 is advanced to a papermaking felt 126 which is supported by a plurality of rolls 114 and the felt 126 is in contact with a shoe press roll 128. The embryonic fibrous structure 122 is of low consistency as it is transferred to the felt 126. Transfer may be assisted by vacuum; such as by a vacuum roll if so desired or a pickup or vacuum shoe as is known in the art. As the embryonic fibrous structure 122 reaches the shoe press roll 128 it may have a consistency of 10-25% as it enters the shoe press nip 130 between shoe press roll 128 and transfer roll 132. Transfer roll 132 may be a heated roll if so desired. Instead of a shoe press roll 128, it could be a conventional suction pressure roll. If a shoe press roll 128 is employed it is desirable that roll 114 immediately prior to the shoe press roll 128 is a vacuum roll effective to remove water from the felt 126 prior to the felt 126 entering the shoe press nip 130 since water from the furnish will be pressed into the felt 126 in the shoe press nip 130. In any case, using a vacuum roll at the roll 114 is typically desirable to ensure the embryonic fibrous structure 122 remains in contact with the felt 126 during the direction change as one of skill in the art will appreciate from the diagram.

The embryonic fibrous structure 122 is wet-pressed on the felt 126 in the shoe press nip 130 with the assistance of pressure shoe 134. The embryonic fibrous structure 122 is thus compactively dewatered at the shoe press nip 130, typically by increasing the consistency by 15 or more points at this stage of the process. The configuration shown at shoe press nip 130 is generally termed a shoe press; in connection with the present invention transfer roll 132 is operative as a transfer cylinder which operates to convey embryonic fibrous structure 122 at high speed, typically 1000 feet/minute (fpm) to 6000 fpm to the patterned molding member section 106 of the present invention, for example a through-air-drying fabric section, also referred to in this process as a creping fabric section.

Transfer roll 132 has a smooth transfer roll surface 136 which may be provided with adhesive and/or release agents if needed. Embryonic fibrous structure 122 is adhered to transfer roll surface 136 which is rotating at a high angular velocity as the embryonic fibrous structure 122 continues to advance in the machine-direction indicated by arrows 138. On the transfer roll 132, embryonic fibrous structure 122 has a generally random apparent distribution of fiber.

Embryonic fibrous structure 122 enters shoe press nip 130 typically at consistencies of 10-25% and is dewatered and dried to consistencies of from about 25 to about 70% by the time it is transferred to the molding member 140 according to the present invention, which in this case is a patterned creping fabric, as shown in the diagram.

Molding member 140 is supported on a plurality of rolls 114 and a press nip roll 142 and forms a molding member nip 144, for example fabric crepe nip, with transfer roll 132 as shown.

The molding member 140 defines a creping nip over the distance in which molding member 140 is adapted to contact transfer roll 132; that is, applies significant pressure to the embryonic fibrous structure 122 against the transfer roll 132. To this end, backing (or creping) press nip roll 142 may be provided with a soft deformable surface which will increase the length of the creping nip and increase the fabric creping angle between the molding member 140 and the embryonic fibrous structure 122 and the point of contact or a shoe press roll could be used as press nip roll 142 to increase effective contact with the embryonic fibrous structure 122 in high impact molding member nip 144 where embryonic fibrous structure 122 is transferred to molding member 140 and advanced in the machine-direction 138. By using different equipment at the molding member nip 144, it is possible to adjust the fabric creping angle or the takeaway angle from the molding member nip 144. Thus, it is possible to influence the nature and amount of redistribution of fiber, delamination/debonding which may occur at molding member nip 144 by adjusting these nip parameters. In some embodiments it may by desirable to restructure the z-direction interfiber characteristics while in other cases it may be desired to influence properties only in the plane of the fibrous structure. The molding member nip parameters can influence the distribution of fiber in the fibrous structure in a variety of directions, including inducing changes in the z-direction as well as the MD and CD. In any case, the transfer from the transfer roll to the molding member is high impact in that the fabric is traveling slower than the fibrous structure and a significant velocity change occurs. Typically, the fibrous structure is creped anywhere from 10-60% and even higher during transfer from the transfer roll to the molding member.

Molding member nip 144 generally extends over a molding member nip distance of anywhere from about ⅛" to about 2", typically ½" to 2". For a molding member 140, for example creping fabric, with 32 CD strands per inch, embryonic fibrous structure 122 thus will encounter anywhere from about 4 to 64 weft filaments in the molding member nip 144.

The nip pressure in molding member nip 144, that is, the loading between roll 142 and transfer roll 132 is suitably 20-100 pounds per linear inch (PLI).

After passing through the molding member nip 144, and for example fabric creping the embryonic fibrous structure 122, a 3D patterned fibrous structure 146 continues to advance along MD 138 where it is wet-pressed onto Yankee cylinder (dryer) 148 in transfer nip 150. Transfer at nip 150 occurs at a 3D patterned fibrous structure 146 consistency of generally from about 25 to about 70%. At these consistencies, it is difficult to adhere the 3D patterned fibrous structure 146 to the Yankee cylinder surface 152 firmly enough to remove the 3D patterned fibrous structure 146 from the molding member 140 thoroughly. This aspect of the process is important, particularly when it is desired to use a high velocity drying hood as well as maintain high impact creping conditions.

In this connection, it is noted that conventional TAD processes do not employ high velocity hoods since sufficient adhesion to the Yankee dryer is not achieved.

It has been found in accordance with the present invention that the use of particular adhesives cooperate with a moderately moist fibrous structure (25-70% consistency) to adhere it to the Yankee dryer sufficiently to allow for high velocity operation of the system and high jet velocity impingement air drying. In this connection, a poly(vinyl alcohol)/polyamide adhesive composition as noted above is applied at 154 as needed.

The 3D patterned fibrous structure is dried on Yankee cylinder 148 which is a heated cylinder and by high jet velocity impingement air in Yankee hood 156. As the Yankee cylinder 148 rotates, 3D patterned fibrous structure 146 is creped from the Yankee cylinder 148 by creping doctor blade 158 and wound on a take-up roll 160. Creping of the paper from a Yankee dryer may be carried out using an undulatory creping blade, such as that disclosed in U.S. Pat. No. 5,690,788, the disclosure of which is incorporated by reference. Use of the undulatory crepe blade has been shown to impart several advantages when used in production of tissue products. In general, tissue products creped using an undulatory blade have higher caliper (thickness), increased CD stretch, and a higher void volume than do comparable tissue products produced using conventional crepe blades. All of these changes affected by the use of the undulatory blade tend to correlate with improved softness perception of the tissue products.

When a wet-crepe process is employed, an impingement air dryer, a through-air dryer, or a plurality of can dryers can be used instead of a Yankee. Impingement air dryers are disclosed in the following patents and applications, the disclosure of which is incorporated herein by reference: U.S. Pat. No. 5,865,955 of Ilvespaaet et al. U.S. Pat. No. 5,968,590 of Ahonen et al. U.S. Pat. No. 6,001,421 of Ahonen et al. U.S. Pat. No. 6,119,362 of Sundqvist et al. U.S. patent application Ser. No. 09/733,172, entitled Wet Crepe, Impingement-Air Dry Process for Making Absorbent Sheet, now U.S. Pat. No. 6,432,267. A throughdrying unit as is well known in the art and described in U.S. Pat. No. 3,432,936 to Cole et al., the disclosure of which is incorporated herein by reference as is U.S. Pat. No. 5,851,353 which discloses a can-drying system.

Figure 7:
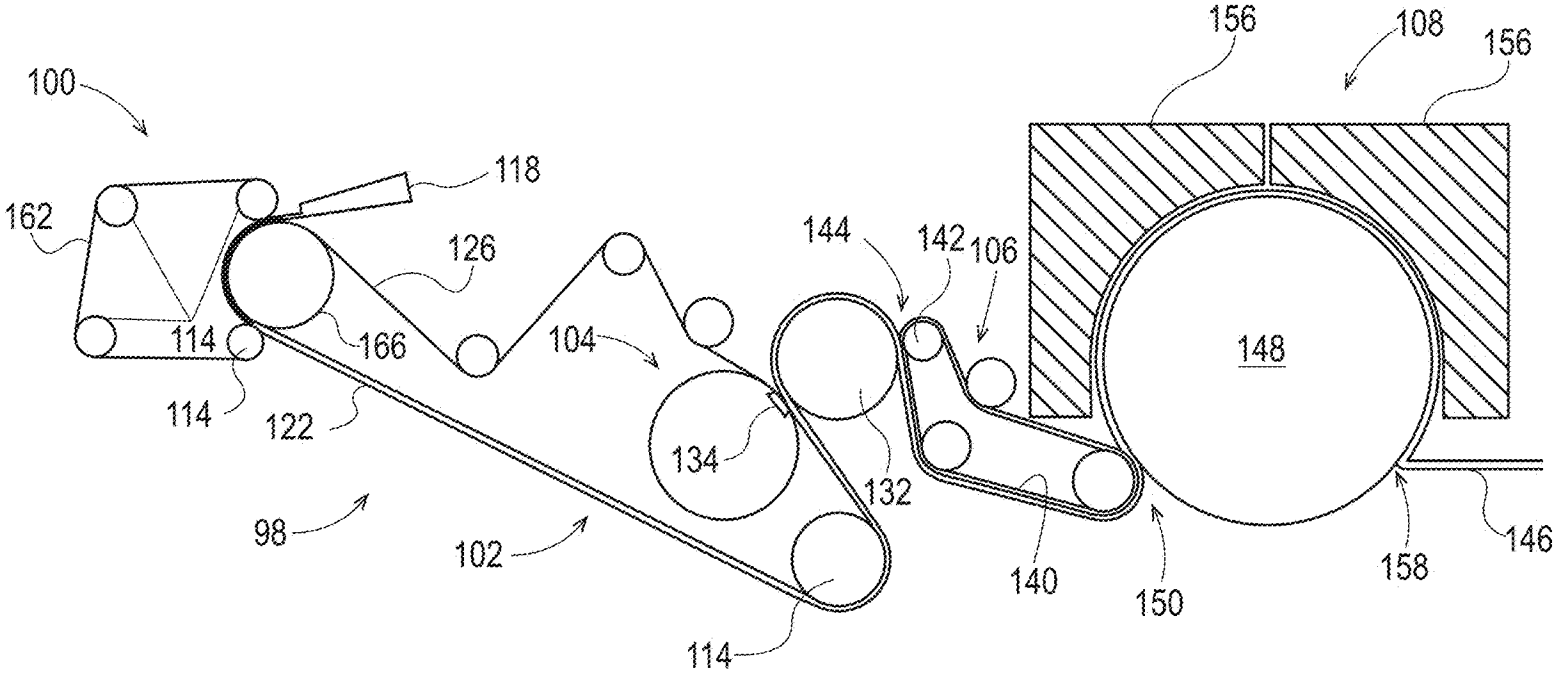
FIG. 7 is a schematic representation of another example of a fabric creped papermaking process for making a sanitary tissue product according to the present invention.

There is shown in FIG. 7 a papermaking machine 98, similar to FIG. 7, for use in connection with the present invention. Papermaking machine 98 is a three fabric loop machine having a forming section 100 generally referred to in the art as a crescent former. Forming section 100 includes a forming wire 162 supported by a plurality of rolls such as rolls 114. The forming section 100 also includes a forming roll 166 which supports paper making felt 126 such that embryonic fibrous structure 122 is formed directly on the felt 126. Felt run 102 extends to a shoe press section 104 wherein the moist embryonic fibrous structure 122 is deposited on a transfer roll 132 (also referred to sometimes as a backing roll) as described above. Thereafter, embryonic fibrous structure 122 is creped onto molding member 140, such as a crepe fabric, in molding member nip 144 before being deposited on Yankee dryer 148 in another press nip 150. The papermaking machine 98 may include a vacuum turning roll, in some embodiments; however, the three loop system may be configured in a variety of ways wherein a turning roll is not necessary. This feature is particularly important in connection with the rebuild of a papermachine inasmuch as the expense of relocating associated equipment i.e. pulping or fiber processing equipment and/or the large and expensive drying equipment such as the Yankee dryer or plurality of can dryers would make a rebuild prohibitively expensive unless the improvements could be configured to be compatible with the existing facility.

Figure 8:
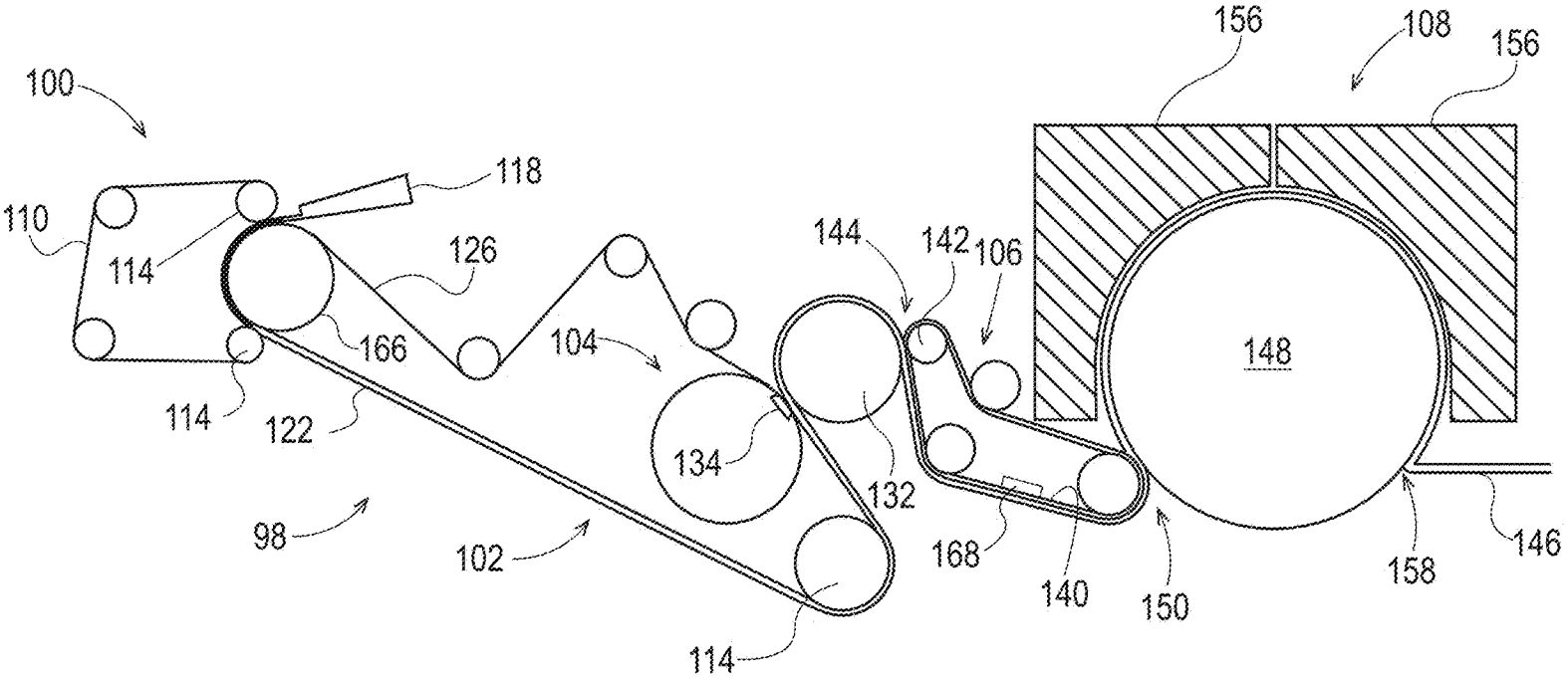
FIG. 8 is a schematic representation of an example of belt creped papermaking process for making a sanitary tissue product according to the present invention.

FIG. 8 shows another example of a suitable papermaking process to make the sanitary tissue products of the present invention. FIG. 8 illustrates a papermaking machine 98 for use in connection with the present invention. Papermaking machine 98 is a three fabric loop machine having a forming section 100, generally referred to in the art as a crescent former. Forming section 100 includes headbox 118 depositing a furnish on forming wire 110 supported by a plurality of rolls 114. The forming section 100 also includes a forming roll 166, which supports papermaking felt 126, such that embryonic fibrous structure 122 is formed directly on felt 126. Felt run 102 extends to a shoe press section 104 wherein the moist embryonic fibrous structure 122 is deposited on a transfer roll 132 and wet-pressed concurrently with the transfer. Thereafter, embryonic fibrous structure 122 is transferred to the molding member section 106, by being transferred to and/or creped onto molding member 140 of the present invention, for example a through-air-drying belt, in molding member nip 144, for example belt crepe nip, before being optionally vacuum drawn by suction box 168 and then deposited on Yankee dryer 148 in another press nip 150 using a creping adhesive, as noted above. Transfer to a Yankee dryer from the creping belt differs from conventional transfers in a conventional wet press (CWP) from a felt to a Yankee. In a CWP process, pressures in the transfer nip may be 500 PLI (87.6 kN/meter) or so, and the pressured contact area between the Yankee surface and the fibrous structure is close to or at 100%. The press roll may be a suction roll which may have a P&J hardness of 25-30. On the other hand, a belt crepe process of the present invention typically involves transfer to a Yankee with 4-40% pressured contact area between the fibrous structure and the Yankee surface at a pressure of 250-350 PLI (43.8-61.3 kN/meter). No suction is applied in the transfer nip, and a softer pressure roll is used, P&J hardness 35-45. The papermaking machine may include a suction roll, in some embodiments; however, the three loop system may be configured in a variety of ways wherein a turning roll is not necessary. This feature is particularly important in connection with the rebuild of a papermachine inasmuch as the expense of relocating associated equipment, i.e., the headbox, pulping or fiber processing equipment and/or the large and expensive drying equipment, such as the Yankee dryer or plurality of can dryers, would make a rebuild prohibitively expensive, unless the improvements could be configured to be compatible with the existing facility.

Non-Limiting Example

The following Example illustrates a non-limiting example for a preparation of a sanitary tissue product comprising a fibrous structure according to the present invention on a pilot-scale Fourdrinier fibrous structure making (papermaking) machine.

An aqueous slurry of eucalyptus (Fibria Brazilian bleached hardwood kraft pulp) pulp fibers is prepared at about 3% fiber by weight using a conventional repulper, then transferred to the hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and equally distributed in the top and bottom chambers of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is then directed to the NSK fan pump where the NSK slurry consistency is reduced from about 3% by fiber weight to about 0.15% by fiber weight. The 0.15% eucalyptus slurry is then directed and distributed to the center chamber of a multi-layered, three-chambered headbox of a Fourdrinier wet-laid papermaking machine.

In order to impart temporary wet strength to the finished fibrous structure, a 1% dispersion of temporary wet strengthening additive (e.g., Parez® commercially available from Kemira) is prepared and is added to the NSK fiber stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

The wet-laid papermaking machine has a layered headbox having a top chamber, a center chamber, and a bottom chamber where the chambers feed directly onto the forming wire (Fourdrinier wire). The eucalyptus fiber slurry of 0.15% consistency is directed to the top headbox chamber and bottom headbox chamber. The NSK fiber slurry is directed to the center headbox chamber. All three fiber layers are delivered simultaneously in superposed relation onto the Fourdrinier wire to form thereon a three-layer embryonic fibrous structure (web), of which about 33% of the top side is made up of the eucalyptus fibers, about 33% is made of the eucalyptus fibers on the bottom side and about 34% is made up of the NSK fibers in the center. Dewatering occurs through the Fourdrinier wire and is assisted by a deflector and wire table vacuum boxes. The Fourdrinier wire is an 84M (84 by 76 5A, Albany International). The speed of the Fourdrinier wire is about 800 feet per minute (fpm).

The embryonic wet fibrous structure is transferred from the Fourdrinier wire, at a fiber consistency of about 16-20% at the point of transfer, to a 3D patterned through-air-drying belt as shown in FIGS. 2A-2C. The speed of the 3D patterned through-air-drying belt is the same as the speed of the Fourdrinier wire. The 3D patterned through-air-drying belt is designed to yield a fibrous structure as shown in FIGS. 3A-3D comprising a pattern of semi-continuous low density pillow regions and semi-continuous high density knuckle regions. This 3D patterned through-air-drying belt is formed by casting an impervious resin surface onto a fiber mesh supporting fabric as shown in FIGS. 2B and 2C. The supporting fabric is a 98×52 filament, dual layer fine mesh. The thickness of the resin cast is about 13 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 50-65% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 80% polyvinyl alcohol (PVA 88-50), about 20% CREPETROL® 457T20. CREPETROL® 457T20 is commercially available from Ashland (formerly Hercules Incorporated of Wilmington, Del.). The creping adhesive is delivered to the Yankee surface at a rate of about 0.15% adhesive solids based on the dry weight of the fibrous structure. The fiber consistency is increased to about 97% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275° F. and a speed of about 800 fpm. The fibrous structure is wound in a roll (parent roll) using a surface driven reel drum having a surface speed of about 695 fpm.

Two parent rolls of the fibrous structure are then converted into a sanitary tissue product by loading the roll of fibrous structure into an unwind stand. The line speed is 400 ft/min. One parent roll of the fibrous structure is unwound and transported to an emboss stand where the fibrous structure is strained to form the emboss pattern in the fibrous structure and then combined with the fibrous structure from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder where it is wound onto a core to form a log. The log of multi-ply sanitary tissue product is then transported to a log saw where the log is cut into finished multi-ply sanitary tissue product rolls. The multi-ply sanitary tissue product of this example exhibits a MD elongation to total foreshortening ratio of greater than 2.25 and even greater than 2.5 as measured according to the Elongation Test Method described herein.

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 2 hours prior to the test. The samples tested are "usable units." "Usable units" as used herein means sheets, flats from roll stock, pre-converted flats, and/or single or multi-ply products. All tests are conducted in such conditioned room. Do not test samples that have defects such as wrinkles, tears, holes, and like. All instruments are calibrated according to manufacturer's specifications.

Basis Weight Test Method

Basis weight of a fibrous structure and/or sanitary tissue product sample is measured by selecting twelve (12) usable units of the fibrous structure and making two stacks of six (6) usable units each. If perforations or folds are present, keep them aligned on the same side when stacking the usable units. A precision cutter is used to cut each stack into exactly 3.500 in.×3.500 in. squares + or −0.0035 in tolerance in each dimension. The two stacks of cut squares are combined to make a basis weight stack of twelve (12) squares thick. The stack is then weighed on a top loading balance with a resolution of 0.001 g. The top loading balance must be protected from air drafts and other disturbances using a draft shield. Weights are recorded when the readings on the top loading balance become constant. The Basis Weight is calculated as follows:

$$\text{Basis Weight (lbs/3000 ft}^2) = \text{Weight of basis weight stack (g)}/[453.6\ \text{g/lbs} \times 12\ \text{usable units}]/[12.25\ \text{in}^2\ \text{(which is the area of basis weight stack)}/144\ \text{in}^2/\text{ft}^2] \times 3000$$

$$\text{Basis Weight (g/m}^2) = \frac{\text{Weight of basis weight stack (g)} \times 10{,}000\ \text{cm}^2/\text{m}^2}{79.0321\ \text{cm}^2\ \text{(Area of basis weight stack)} \times 12\ \text{(usable units)}}$$

Report result to the nearest 0.1 (lbs/3000 $ft^2$ or $g/m^2$) Sample dimensions can be changed or varied using a similar precision cutter as mentioned above so long as at least 100 $in^2$ (accurate to +/−0.1 $in^2$) of sample area is measured and weighed on a top loading calibrated balance with a resolution of 0.001 g or smaller as described above.

Tensile Strength, Elongation, TEA and Modulus Test Methods

Four stacks of usable units are prepared using five samples in each stack. If the samples have a MD and CD to them, then samples in two stack are oriented in the same way with respect to MD and two stacks are oriented in the same way with respect to CD. (Fibrous structures which lack MD:CD orientation are used without this distinction.) The sample size needs to be sufficient for the tests described below. Two of the stacks are marked for testing in the MD and two for CD. A total of 8 strips are obtained by cutting 4 samples in the MD and 4 samples in the CD of dimensions 1.00" wide (2.54 cm) and at least 5" long.

A constant rate of extension tensile tester with computer interface ( ) (such as EJA Vantage from Thwing-Albert Instrument Co. of West Berlin, N.J.) equipped with pneumatic 1 inch wide flat face steel grips, supplied with 60+/−2 psi air pressure. The instrument is calibrated according to manufacturer's specifications. If slippage of a sample in the grips is observed, then increase the clamping pressure and run a new sample.

The crosshead speed is set to 4.00 in/min (10.16 cm/min). Gauge length set to 4.00 inches. Other instrument software parameters are set as follows: break sensitivity is set to 50% (i.e., test is completed when force drops to 50% of its maximum peak force), the sample width is set to 1.00 inch, and Pre-Tension force is set to 11.12 grams. The data acquisition rate is set to 20 points/second of both the force (g) and displacement (inches) data. The load cell on the instrument is first zeroed and the cross head position set to zero. A sample strip (1 inch wide by 1 usable unit thick) is first clamped in the upper grip of the tensile tester, followed by clamping the sample in the lower grip, with the long dimension of the sample strip running parallel to the sides of the tensile tester and centered within the grips. At least about 0.5 inches of sample must be clamped inside the upper and lower grips as measured from the front face of the grip. If more than 5 grams of force is observed just after both grips are closed, then the sample is too taught, and must be replaced with a new sample strip. The sample is too loose if, after 3 seconds following test initiation, less than 1 gram of force or less is recorded.

After the sample is loaded, the tensile program is initiated. The test is complete after the sample ruptures and the recorded tensile load falls to 50% of its peak value. When the test is complete, the following calculations are made on the acquired force (g) vs. displacement (inches) data, for both MD and CD tests.

The peak tensile strength is the maximum force recorded during the test, reported in force per unit of sample width, (g/in to the nearest 1 g/in). In order to calculate Peak Elongation, TEA, and Modulus, the acquired displacement data values are used to calculate strain values. The initial cross-head position is zero displacement position. The displacement distance data point at which the tensile force exceeds the Pre-Tension force (i.e, displacement distance just after 11.12 g) is termed the Pre-Tension Displacement (in). The Adjusted Gauge Length is defined as the sum of the Gauge Length (in this case 4.00 inches) and the Pre-Tension Displacement, and it also defines the zero strain point. Absolute strain values are calculated by dividing the acquired displacement values (in) by the Adjusted Gauge Length (in). Absolute strain can be converted to % Strain by multiplying by 100.

Peak Elongation is measured as the percent strain at the point of maximum force (units of %).

TEA is calculated by integrating the area under the tensile force (g) vs. displacement data (in) curve, from zero displacement up to peak force displacement, and dividing by the product of the Adjusted Gauge Length (in) and the sample width (1.00 in). TEA units are g*in/in$^2$ (which can be converted into g*cm/cm$^2$ as needed).

Modulus is defined here as the tangent slope from the force vs. strain data at 38.1 grams force. It is calculated by linear regression of 11 data acquisition points, centered at the first data point recorded just after the tensile force surpasses 190.5 g (38.1 g×5 layers), including next 5 points, as well as the previous 5 points (to make 11 total points). The slope of this linear regression results in the tangent slope with units of force divided by strain per unit sample width (2.54 cm), i.e., g/cm. (if there are not five points prior to 38.1 g increase the data rate)

Additional 3 samples are tested the same manner. The 4 MD sample results are averaged, and the 4 CD results are averaged, in terms of calculating Peak Load, Peak Elongation, TEA, and Modulus. Additional calculated terms are shown below.

Calculations:

Total Dry Tensile Strength (TDT)=Peak Load MD Tensile (g/in)+Peak Load CD Tensile (g/in)

Total_Modulus=MD Modulus (g/cm*% at 15 g/cm)+ CD Modulus (g/cm*% at 15 g/cm)

The stress(Tensile)/strain(Elongation) analysis for each of the samples was done with unconverted fibrous structures (not finished fibrous structures).

Orthogonal Regression Curves and Slopes:

The data used to generate the orthogonal slopes for each of the samples include tensile and elongation beginning at 1% elongation and ending at peak load elongation.

Modulus Curves

Additionally, the curves depicting the modulus characteristic between the sample pairs utilized the same dataset mentioned above. Modulus for each stress/strain data point for each of samples was calculated as follows:

$$E=s/\epsilon$$

Where:

E=modulus s=tensile (stress)

e=elongation (strain)

Note: The above calculation is actually Young's Modulus which states:

$$E=\frac{\text{Tensile stress}}{\text{Tensile strain}}=\frac{s}{\epsilon}=\frac{F/A_0}{\Delta L/L_0}=\frac{FL_0}{A_0\Delta L}$$

Where:

E is the Young's modulus (modulus of elasticity)

F is the force exerted on an object under tension;

$A_0$ is the original cross-sectional area through which the force is applied;

ΔL is the amount by which the length of the object changes;

$L_0$ is the original length of the object.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for making a fibrous structure, the method comprising the steps of:

a. providing a plurality of pulp fibers;

a. depositing the pulp fibers on a forming wire to form a fibrous structure; and b. applying the fibrous structure to a through-air-drying member such that one or more discrete knuckle regions are imparted to the fibrous structure such that a sanitary tissue product made therefrom exhibits a MD elongation to total foreshortening ratio of greater than 2.25 as measured according to the Elongation Test Method, wherein the fibrous structure is void of a continuous knuckle region.

2. The method according to claim 1 wherein the fibrous structure exhibits differential density.

3. The method according to claim 2 wherein the fibrous structure exhibits a low density pillow regions and high density knuckle regions.

4. The method according to claim 1 wherein the sanitary tissue product is a single- or multi-ply sanitary tissue product.

5. A method for making a fibrous structure, the method comprising the steps of:

a. providing a plurality of pulp fibers;

b. depositing the pulp fibers on a forming wire to form a fibrous structure; and c. applying the fibrous structure to a through-air-drying member such that the fibrous structure is imparted a pattern of semi-continuous high density knuckle regions and a pattern of semi-continuous low density pillow regions, such that the fibrous structure exhibits a MD elongation to total foreshortening ratio of greater than 2.25 as measured according to the Elongation Test Method, and wherein the fibrous structure is void of a continuous knuckle region.

6. The method according to claim 5 wherein a plurality of the high density knuckle regions are oriented substantially in the cross-machine direction.

7. The method according to claim 6 wherein the plurality of the high density knuckle regions comprise curvilinear lines.

8. The method according to claim 6 wherein the plurality of the high density knuckle regions comprise sinusoidal lines.

9. The method according to claim 5 wherein the sanitary tissue product is a single-or multi-ply sanitary tissue product.

10. A method for making a fibrous structure, the method comprising the steps of:

a. providing a plurality of pulp fibers;

b. depositing the pulp fibers on a forming wire to form a fibrous structure;

c. subjecting the fibrous structure to 0% or greater wet microcontraction; and d. applying the fibrous structure to a through-air-drying member such that the fibrous structure exhibits a MD elongation to total foreshortening ratio of greater than 2.5 as measured according to the Elongation Test Method, and wherein the fibrous structure is void of a continuous knuckle region.

11. The method according to claim 10 wherein the fibrous structure exhibits differential density.

12. The method according to claim 11 wherein the fibrous structure exhibits low density pillow regions and high density knuckle regions.

13. The method according to claim 11 wherein the fibrous structure exhibits high density knuckle regions present in a semi-continuous pattern and low density pillow regions present in a semi-continuous pattern.

14. The method according to claim 10 wherein the sanitary tissue product is a single- or multi-ply sanitary tissue product.

* * * * *